US009562487B2

(12) United States Patent
Shaver et al.

(10) Patent No.: US 9,562,487 B2
(45) Date of Patent: Feb. 7, 2017

(54) METHOD AND APPARATUS FOR DYNAMIC SURFACE CONTROL OF A PIEZOELECTRIC FUEL INJECTOR DURING RATE SHAPING

(71) Applicant: Purdue University, West Lafayette, IN (US)

(72) Inventors: Gregory M. Shaver, Lafayette, IN (US); Dat Duc Le, Columbus, IN (US); Bradley W. Pietrzak, Warsaw, IN (US)

(73) Assignee: PURDUE RESEARCH FOUNDATION, West Lafayette, IN (US)

( * ) Notice: Subject to any disclaimer, the term of this patent is extended or adjusted under 35 U.S.C. 154(b) by 356 days.

(21) Appl. No.: 14/449,624

(22) Filed: Aug. 1, 2014

(65) Prior Publication Data

US 2016/0032856 A1 Feb. 4, 2016

(51) Int. Cl.

| | |
|---|---|
| ***F02M 51/06*** | (2006.01) |
| ***F02D 41/20*** | (2006.01) |
| ***F02M 45/12*** | (2006.01) |
| ***F02D 41/14*** | (2006.01) |
| *F02M 63/02* | (2006.01) |

(52) U.S. Cl.

CPC ..... *F02D 41/2096* (2013.01); *F02D 41/1401* (2013.01); *F02M 45/12* (2013.01); *F02M 51/0603* (2013.01); *F02D 2041/143* (2013.01); *F02D 2041/1437* (2013.01); *F02D 2041/2051* (2013.01); *F02D 2200/0602* (2013.01); *F02M 63/0225* (2013.01); *F02M 2200/704* (2013.01)

(58) Field of Classification Search

CPC ..... F02M 51/0603; F02M 51/0607; F02D 41/3827; F02D 2200/0602

USPC ..... 701/104

See application file for complete search history.

(56) References Cited

U.S. PATENT DOCUMENTS

| | | | | |
|---|---|---|---|---|
| 2008/0006243 | A1 | 1/2008 | Fujii | |
| 2009/0038589 | A1* | 2/2009 | Dingle | F02D 41/3827 123/480 |
| 2013/0019842 | A1* | 1/2013 | Shaver | F02C 9/26 123/478 |
| 2013/0327301 | A1* | 12/2013 | Brandt | F02D 41/2096 123/478 |
| 2014/0346244 | A1* | 11/2014 | Russe | F02D 41/2096 239/4 |

FOREIGN PATENT DOCUMENTS

| | | |
|---|---|---|
| WO | 2014/039800 | 3/2014 |
| WO | 2014/107487 | 7/2014 |

OTHER PUBLICATIONS

International Report on Patentability dated Sep. 12, 2016 in International Application No. PCT/US2015/043108.

* cited by examiner

*Primary Examiner* — Erick Solis

(74) *Attorney, Agent, or Firm* — Faegre Baker Daniels LLP

(57) ABSTRACT

A system and method are provided for monitoring a pressure of fuel supplied to the fuel injector, and providing a control input voltage to the piezostack in response to the pressure to cause the injector to provide a fuel injection having a desired shape. In the system and method, providing a control input voltage includes applying a model-based algorithm to the pressure to determine the control input voltage.

21 Claims, 20 Drawing Sheets

METHOD AND APPARATUS FOR DYNAMIC SURFACE CONTROL OF A PIEZOELECTRIC FUEL INJECTOR DURING RATE SHAPING

TECHNICAL FIELD

The present disclosure relates generally to fuel injection for internal combustion engines and more specifically to fuel injection rate shaping using a model-based closed-loop controller.

BACKGROUND

Various fuel injectors are known, including solenoid actuated fuel injectors and piezoelectrically actuated fuel injectors. Compared with solenoid actuated fuel injectors, piezoelectrically actuated injectors have a higher bandwidth, which allows for the delivery of more complex injection rate profiles, examples including tightly-spaced pulse trains and rate shaping. As is known in the art, injection rate shaping may reduce overall fuel consumption and improve the trade-off between NOx and particulate matter emissions.

A boot shape injection profile is depicted in FIG. 1, and is an example of rate shaping. Profile 100 includes a "toe" 102 and a "shank" 104. Profile 100 may provide benefits for diesel engines operating at high load and medium speed. Various techniques may be employed for rate shaping. In U.S. Pat. No. 6,079,641, a piezoelectric fuel injector with open-loop control is disclosed for producing rate shaped injections. In Kohketsu, S., Tanabe, K., and Mori, K., 2000, "Flexibly controlled injection rate shape with next generation common rail system for heavy duty DI diesel engines," *SAE Technical Paper* (2000-01-0705), a system with two common rails is disclosed for creating rate shaped injection profiles. In U.S. Pat. No. 7,896,257, a position sensor is disclosed for estimating fueling rate for the purpose of closed-loop injection rate control and failure diagnosis. In Wu, C., and Sun, Z., 2013, "Design and control of a direct fuel injector with rate shaping capability," *American Control Conference* 2013, Washington, D.C., an injector design is outlined which can enable rate shaping by utilizing an internal feedback mechanism.

SUMMARY

The present disclosure provides within-an-engine-cycle control of rate shaping. In one embodiment, the present disclosure provides a method, comprising monitoring a pressure of fuel supplied to a fuel injector of an engine, and providing a control input voltage to a piezostack of the fuel injector in response to the pressure to cause the injector to provide a fuel injection having a desired shape. In this embodiment, providing a control input voltage includes applying a model-based algorithm to the pressure to determine the control input voltage. In one aspect of this embodiment, providing a control input voltage includes causing the injector to provide a fuel injection having a boot shape with a shank wherein a needle valve of the fuel injector is fully opened and a toe wherein the needle valve is partially opened. In another aspect, providing a control input voltage includes applying a state space model having seven dynamic states to the pressure. In another aspect, providing a control input voltage includes applying a model-based algorithm having a hysteresis model of the piezostack to the voltage of the piezostack. In yet another aspect of this embodiment, the control input voltage is provided to the piezostack to cause an upper section of the needle valve to move to a desired position which is determined by applying the model-based algorithm, the desired position corresponding to a desired fuel flow rate through a needle valve of the fuel injector. In still another aspect, this embodiment further includes repeating monitoring the pressure, and providing the control signal a plurality of times during each cycle of operation of the engine.

According to another embodiment of the present disclosure, a system is provided, comprising a piezostack driver configured to provide a stack voltage to a piezostack of a fuel injector of an engine, a voltage sensor disposed in electrical communication with the stack voltage and configured to provide stack voltage measurement signals representing the stack voltage, a pressure sensor disposed in fluid communication with a fuel supply to the fuel injector and configured to provide line pressure measurement signals representing a fuel pressure of a body of the injector, and a controller coupled to the piezostack driver, the voltage sensor, and the pressure sensor, the controller including logic to apply the line pressure measurement signals to a model of the fuel injector to generate control input signals, the controller providing the control input signals to the piezostack driver to cause the piezostack driver to provide stack voltages such that the fuel injector provides a fuel injection having a desired shape. In one aspect of this embodiment, the model includes a state space model having seven dynamic states. In another aspect, the control input signals are generated to cause the piezostack driver to provide stack voltages such that the fuel injector provides a fuel injection having a boot shape with a shank wherein a needle valve of the fuel injector is fully opened and a toe wherein the needle valve is partially opened. In yet another aspect, the model includes a hysteresis model of the piezostack of the fuel injector. In another aspect, the controller logic applies the line pressure measurement signals to the model a plurality of times during each cycle of operation of the engine. In still another aspect of this embodiment, the controller is an FPGA based controller.

In another embodiment of the present disclosure, a controller is provided, comprising a feedback interface configured to receive line pressure measurement signals representing fuel pressures of a body of the fuel injector, a control interface configured to output control signals to a piezostack driver associated with the fuel injector, and an FPGA coupled to the feedback interface and the control interface, the FPGA being programmed to apply the line pressure measurement signals to a model-based algorithm and providing resulting control signals through the control interface to cause the injector to provide a fuel injection having a desired shape. In one aspect of this embodiment, the desired shape is a boot shape with a shank wherein a needle valve of the fuel injector is fully opened and a toe wherein the needle valve is partially opened. In another aspect, the model-based algorithm includes a state space model having seven dynamic states. In another aspect, the model-based algorithm includes a hysteresis model of the piezostack of the fuel injector. In another aspect, the FPGA generates the control signals to cause the injector to provide a fuel injection a plurality of times in a single engine cycle. In yet another aspect of the present disclosure, the FPGA generates the control signals to cause an upper section of a needle valve of the fuel injector to move to a desired position corresponding to a desired fuel flow rate through the needle valve. In another aspect, the FPGA is configured to generate a control signal in response to a line pressure measurement signal at least once every eight microseconds. In still another aspect, the feedback interface receives the line pressure measurement signals at a sampling rate of at least 500 kHz.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein.

Figure 1:
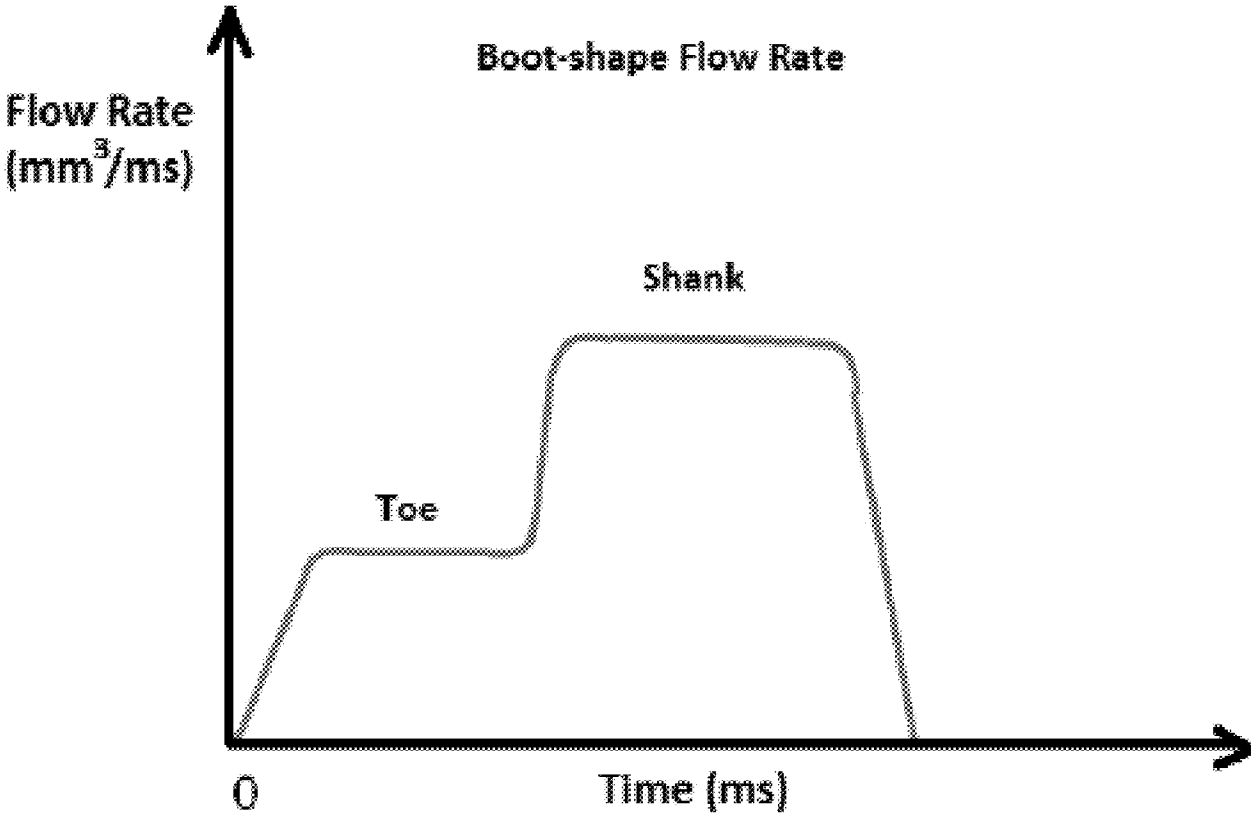
FIG. 1 is a graphical representation of a boot-shaped fuel injection.

Although the drawings represent embodiments of the various features and components according to the present disclosure, the drawings are not necessarily to scale and certain features may be exaggerated in order to better illustrate and explain the present disclosure. The exemplification set out herein illustrates embodiments of the disclosure, and such exemplifications are not to be construed as limiting the scope of the disclosure in any manner.

DETAILED DESCRIPTION OF EMBODIMENTS

For the purpose of promoting an understanding of the principles of the disclosure, reference will now be made to the embodiments illustrated in the drawings, which are described below. It will nevertheless be understood that no limitation of the scope of the disclosure is thereby intended. The disclosure includes any alterations and further modifications in the illustrated device and described methods and further applications of the principles of the disclosure, which would normally occur to one skilled in the art to which the disclosure relates. Moreover, the embodiments were selected for description to enable one of ordinary skill in the art to practice the disclosure.

Referring again to FIG. 1, among the different rate shapes, boot shape profile 100is challenging to form since the injection rate is very sensitive to needle displacement during toe 102. To deliver the desired boot shape injection rate profiles, the present disclosure provides a model-based closed-loop control strategy that employs dynamic surface control (DSC). Further details regarding the dynamic modeling of a piezoelectric fuel injector according to the present disclosure are provided in Le, D., Shen, J., Ruikar, N., and Shaver, G. M., 2014, "Dynamic modeling of a piezoelectric fuel injector during rate shaping operation," *International Journal of Engine Research,* 15(4). While backstepping is a flexible strategy for controlling nonlinear systems, it suffers from the issue of "explosion of terms" due to the high relative degree of the model. Instead of analytically calculating the virtual control derivatives as in backstepping, the dynamic surface control of the present disclosure uses first-order low-pass filters to approximate the derivatives numerically. As such, DSC requires less computational effort. In addition, DSC is capable of attenuating high frequency measurement noise as a result of the approximation of derivatives via low-pass filters. The strategy of numerical derivatives can use different forms of low-pass filters such as the linear and nonlinear second-order low-pass filters in Farrell, J. A., Polycarpou, M., Sharma, M., and Dong, W., 2009, "Command filtered backstepping," *IEEE Transactions on Automatic Control,* 54(6) and Yoon, S., Kim, Y., and Park, S., 2012, "Constrained adaptive backstepping controller design for aircraft landing in wind disturbance and actuator stuck," *International Journal of Aeronautical and Space Sciences,* 13(1), respectively. In Song, B., Hedrick, J. K., and Howell, A., 2002, "Robust stabilization and ultimate boundedness of dynamic surface control systems via convex optimization," *International Journal of Control,* 75(12), convex optimization was used for selecting the controller gains. However, in the present disclosure, the gains and the time constants of the linear first-order low-pass filters are tuned experimentally.

The present disclosure provides: i) model-based development of an algorithm for "within-an-engine-cycle" control of fuel injection rate shaping with a piezoelectric fuel injector, ii) model-based stability analysis, iii) validation in simulation, and iv) experimental validation via algorithm implementation with an FPGA. These aspects of the present disclosure incorporate a dynamic nonlinear model and a real-time injection flow rate estimation strategy. The controller is implemented on the NICompactRIO, although any of a variety of different controller structures with sufficient sampling rate may be used. The NICompactRIO sends a signal to a QorTek piezostack driver in one embodiment, and functions as a DAQ system, which receives measurements of line pressure, piezostack voltage, mean flow rate, and injection rate shape. In one embodiment, an analog 200 kHz anti-aliasing filter is placed before the DAQ, which samples at rate of 500 kHz. The driver, and therefore the control input is limited to an updating period of 10.24 microseconds. A piezoelectric pressure sensor is installed underneath the injector to measure pressure shape in experimental verification, and thus the shape of injection flow rate. Real-time injection flow rate is scaled from the rate shape to have its area under the curve equal to mean flow value, which is measured by a flow meter as is further described below.

Figure 2:
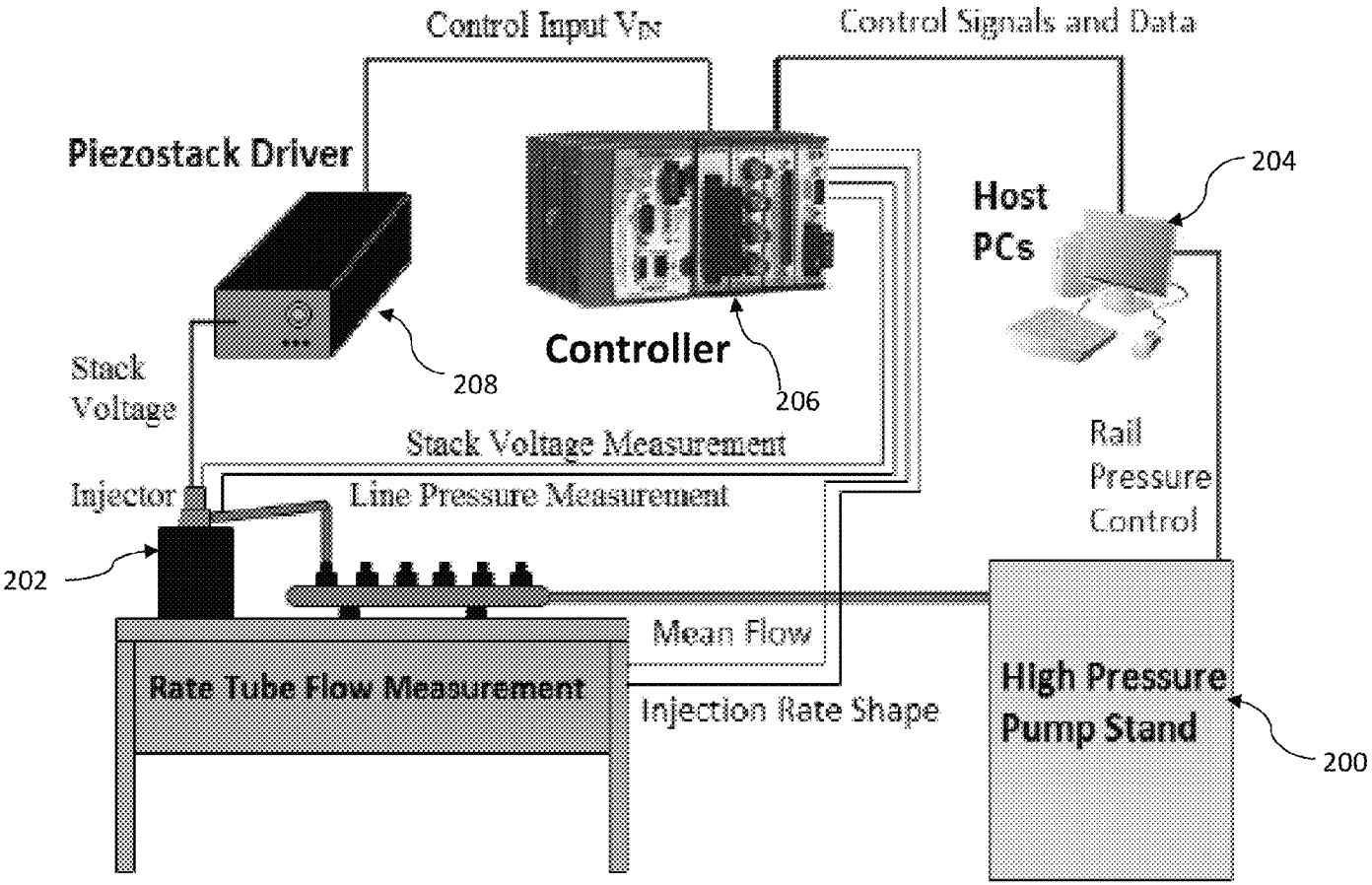
FIG. 2 is a conceptual diagram of an experimental setup for a system according to the present disclosure.

The experimental setup is shown in FIG. 2. A high pressure pump 200 is used to provide pressurized fuel to the piezoelectric fuel injector 202. The host PCs 204 are used for data logging and communication with the Engine Control Module ("ECM"; not shown) to control rail pressure. Real-time data acquisition (DAQ) and control are implemented with an NI CompactRIO FPGA system or controller 206. The controller 206 sends a control signal to a QorTek piezostack driver 208, and receives measurements of line pressure, piezostack voltage, mean flow rate, and injection rate shape. The DAQ is run with a sampling frequency of 500 kHz and an analog 200 kHz anti-aliasing filter, while the driver 208 has an update period of 10.24 microseconds. The injection flow rate measurement system utilizes a rate-tube approach as disclosed in Bosch, W., 1966, "Fuel rate indicator: a new measuring instrument for display of the characteristics of individual injection," *SAE Technical Paper* (660749).

Figure 3:
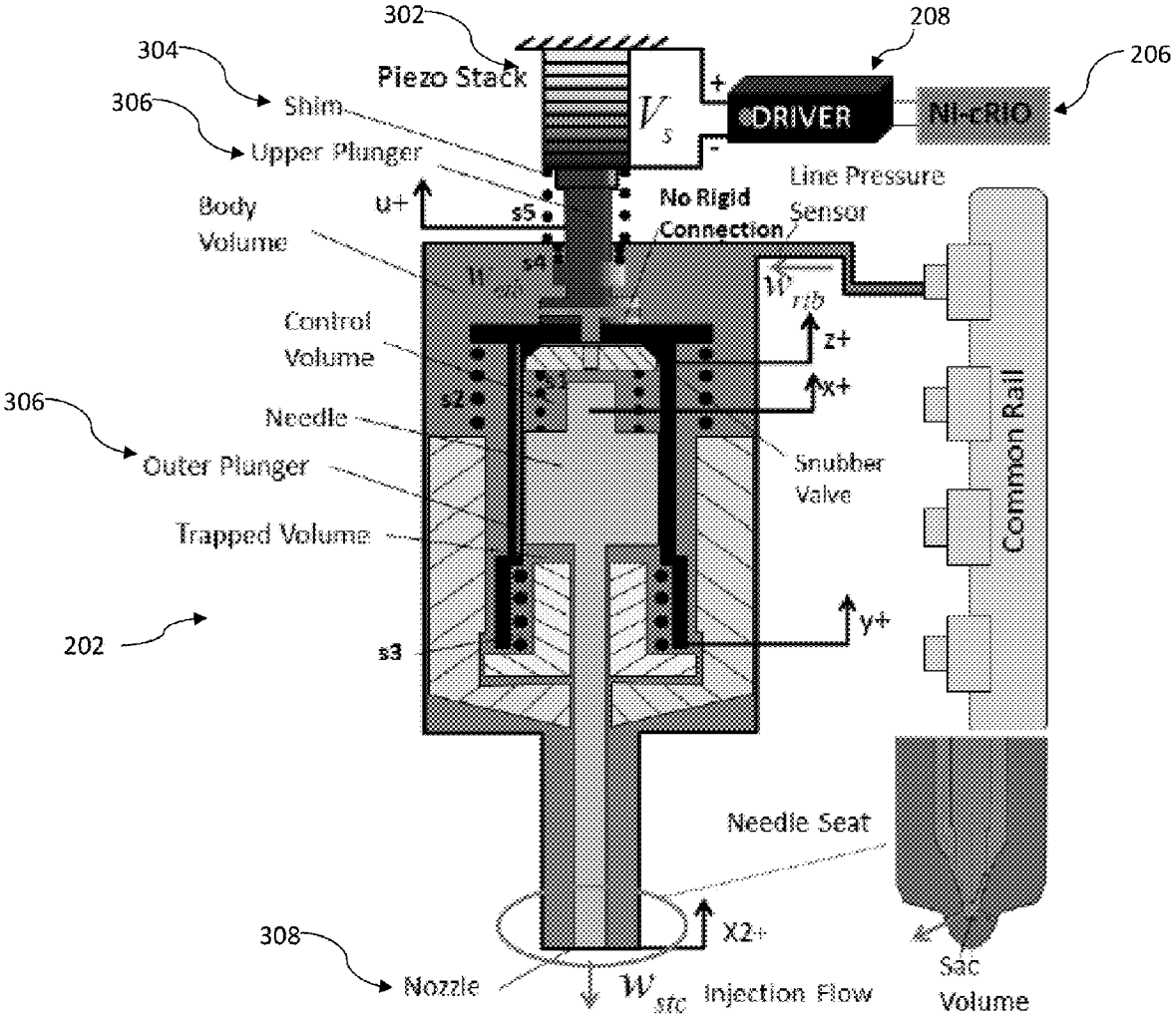
FIG. 3 is a schematic diagram of a piezoelectric fuel injector.

Referring now to FIG. 3, a schematic diagram of piezoelectric fuel injector 202 is shown. When driver 208 applies a voltage across the piezostack 302, stack 302 expands and forces the shim 304 and the plungers 306 down. The trapped volume pressure is then increased, causing the needle 308 to open and allow injection to occur. When driver 208 stops applying voltage, piezostack 302, shim 304, and plungers 306 retract under the pressure forces. Therefore, the trapped volume pressure is decreased, resulting in closing the nozzle 308 and stopping the injection.

Regarding the dynamics of piezostack 302, shim 302, and plungers 306, together they are lumped into a mass M with spring constant k as in the dynamic equation of motion:

$$M\ddot{y}=PL_{tot}-(k_{tot}+k)y-b_1\dot{y}++A_{bv}P_{bv}+A_{obot}P_{tv}-f(V_s) \tag{1}$$

where y, $PL_{tot}$, $K_{tot}$, $b_1$, $P_{tv}$, and $f(V_s)$ are the displacement, total preload, total stiffness of the springs, damping ratio, areas of the injector parts, trapped volume pressure, and piezostack force, respectively (descriptions of all of the variables, subscripts, and parameters in this disclosure are summarized in Table A.2 below).

TABLE A.2

| Vars, params, scripts | Descriptions |
|---|---|
| A[mm$^2$], b[Ns/m] | Area, viscous friction coefficient |
| $f(V_s)$, $F_{bv}$, $F_{vc}$[N] | Stack force, pressure forces |
| $F_{damp}$, $F_s$[N] | Viscous friction force, spring force |
| $F_{ns}$[N] | Needle seat force |
| k[N/m] | Equivalent stiffness of stack, shim, and plungers |
| $k_l$[mm$^5$/msN] | Leakage coefficient |
| $k_s$, $k_n$, $k_{ns}$[N/m] | Stiffness of spring, needle, and needle seat |
| m[kg], M[kg] | Mass of needle, mass |
| $P_{line}$, $P_{sac}$[N/mm$^2$] | Measured line, sac pressures |
| PL[N] | Spring preload |
| R[(kg/mm$^7$)$^{1/2}$] | Fluid resistance |
| $S_i$, $y_i$ | Surface, boundry layer errors |
| y[mm], V[mm$^3$] | Displacement, volume |
| $V_s$[V] | Stack voltage |
| w[mm$^3$/ms] | Volumetric injection rate |
| $X_i$, $X_{id}$[mm] | Actual, desired state variables |
| $x_1$, $x_2$[mm] | Needle displacements |
| β[N/mm$^2$], ρ[kg/m$^3$] | Bulk modulus, fuel density |
| bts | Body volume to sac volume |
| bv, tv | Body, trapped volumes |
| cyl, DSC | Cylinder, dynamic surface control |
| l, ntop, ntip | Leakage, needle top, needle, tip |
| nbot, obot | Needle, outer plunger bottoms |
| otop, up | Outer plunger top, upper plunger |
| sac, sh, s | Sac volume, spray holes, spring |
| ns, stc | Needle seat, sac to cylinder |
| tub | Measurement tube |

The dynamics of needle 308 are discussed below. When needle 308 is closed, the dynamic equation is:

$$m\ddot{x}_1 = P_{tv}A_{nbot} - b_3\dot{x}_1 - P_{bv}A_{ntop} - PL_{s1} + -k_{s1}x_1 + \frac{k_n}{k_n + k_{ns}}F_{ns} - \frac{k_n k_{ns}}{k_n + k_{ns}}x_1 \tag{2}$$

-continued $$x_2 = \frac{F_{ns} + k_n x_1}{k_n + k_{ns}} \leq 0 \tag{3}$$

When needle 308 is opened, the dynamic equation is:

$$m\ddot{x}_1 = P_{tv}A_{nbot} - b_3\dot{x}_1 - P_{bv}A_{ntop} + -PL_{s1} - k_{s1}x_1 + F_{ns} \tag{4}$$

$$x_2 = x_1 + \frac{F_{ns}}{k_n} > 0 \tag{5}$$

where $x_1$, $x_2$ are the needle top and needle tip displacements, and the needle seat force is $$F_{ns}=P_{bv}(A_{ntip}-A_{sac})+P_{sac}A_{sac} \tag{6}$$

The body volume pressure is modeled equal to line pressure, $P_{bv}=P_{line}$. Since line pressure is measurable, body volume pressure $P_{bv}$ is considered as a measured disturbance in the control scheme. The variation of trapped volume over the course of an injection event is relatively small compared to the trapped volume at the initial condition. Therefore, in one embodiment of the disclosure, the trapped volume pressure dynamics is modeled to be linear based on the fluid capacitance relation:

$$\dot{P}_{tv} = -\beta\frac{A_{nbot}\dot{x}_1 + A_{obot}\dot{y} + k_l(P_{tv} - P_{bv})}{V_{tv0}} \tag{7}$$

where bulk modulus is β function of rail pressure $P_{rail}$, and $k_1$ is the leakage coefficient. During an injection event, $P_{rail}$ is considered constant.

Figure 4:
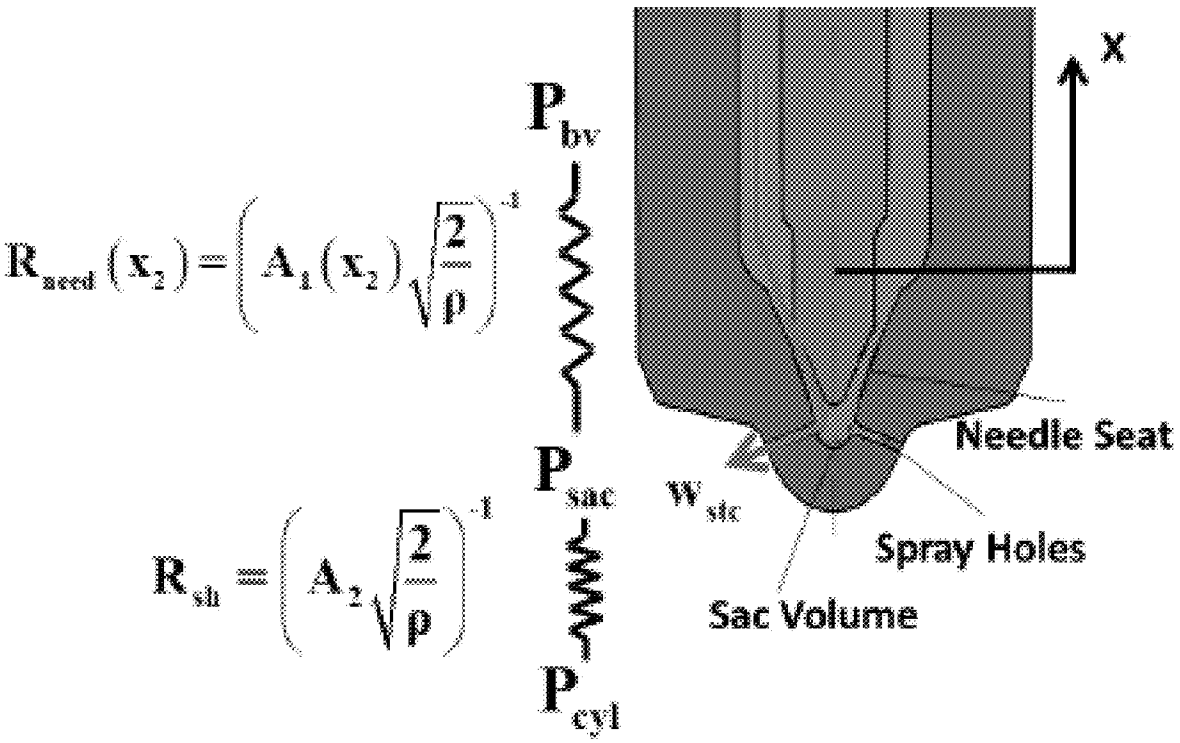
FIG. 4 is a model diagram of a tip of the needle depicted in FIG. 3.

Referring now to FIG. 4, the fuel densities in different volumes of injector 202 are considered to be equal. Therefore, the expressions for sac pressure and the volumetric injection flow rate, become:

$$P_{sac} = \frac{A_1^2 P_{bv} + A_2^2 P_{cyl}}{A_1^2 + A_2^2} \tag{8}$$

$$w_{stc} = \frac{A_1 A_2}{\rho_{tub}}\sqrt{\frac{2\rho(P_{bv} - P_{cyl})}{A_1^2 + A_2^2}} \tag{9}$$

where $A_1(x_2)$, $A_2$ are the effective areas of the needle seat and spray holes (FIG. 4), fuel density ρ is a function of rail pressure, and $\rho_{tub}$ is fuel density in the measurement tube at 1 bar, 55° C.

Figure 5:
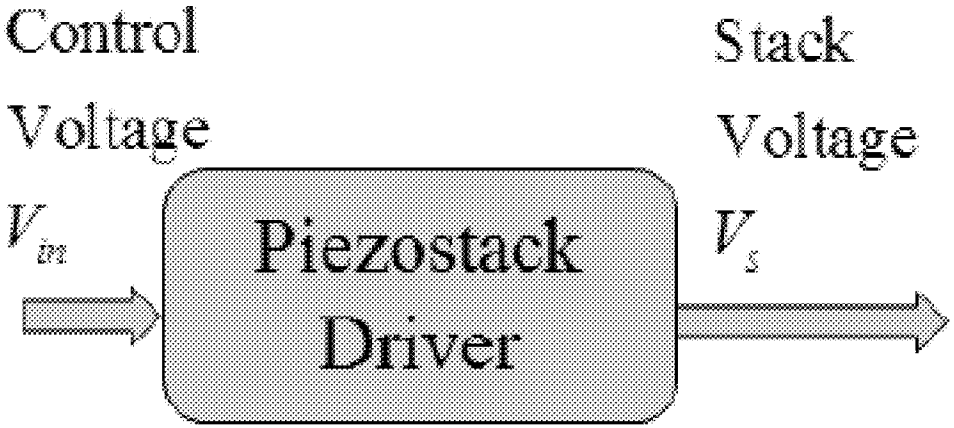
FIG. 5 is a block diagram of a driver according to the present disclosure.
Figure 6:
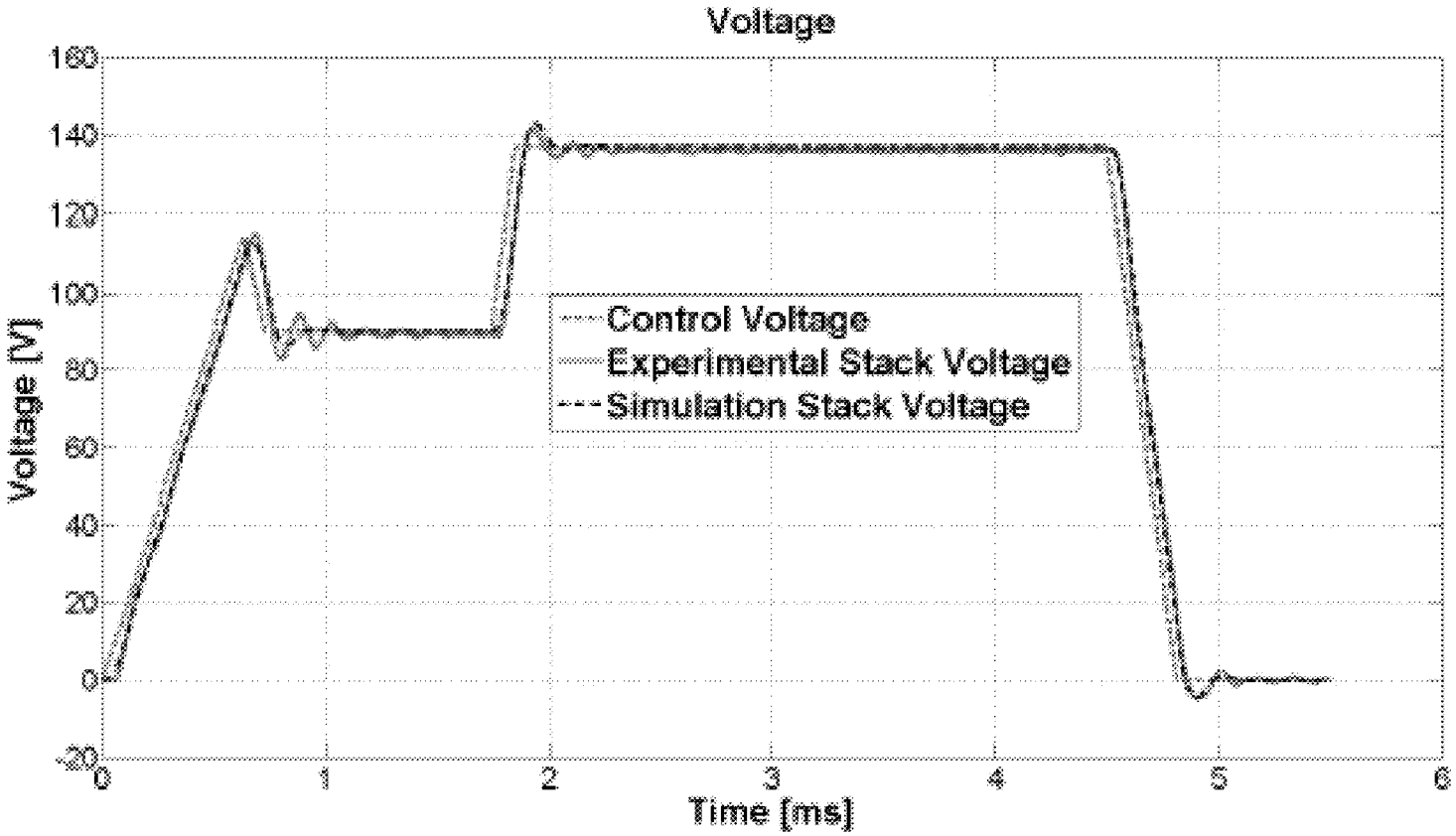
FIG. 6 is a graphical representation of experimental and simulated performance of the driver of FIG. 5.

A driver model block diagram of one embodiment of the present disclosure is shown in FIG. 5. The controller 206 sends a control voltage $V_{in}$ to the driver, resulting in a measurable stack voltage $V_s$. Since the injection system has a high bandwidth, piezostack driver 302 dynamics are non-negligible. Therefore, a driver model is necessary for control development. As shown in FIG. 6, piezostack driver exhibits a second-order response:

$$\ddot{V}_s+2\zeta_d\omega_d\dot{V}_s+\omega_d^2V_s=\omega_d^2V_{in} \tag{10}$$

where $\omega_d$ and $\zeta_d$ are the natural frequency and damping coefficient of the driver model, respectively. The validation of the driver model shows a match between simulation and experimental stack voltages.

The model employed by the present disclosure may be represented by seven model states. The model states are defined as:

$$X_1=y-y(0)$$

$$X_2=\dot{y}$$

$$X_3=x_1-x_1(0)$$

$$X_4=\dot{x}_1$$

$$X_5=P_{rail}-P_{tv}$$

$$X_6=V_s$$

$$X_7=\dot{V}_s \qquad (11)\text{-}(17)$$

where $P_{tv}(0)=P_{rail}$, and $y(0)$, $x_1(0)$, which depend on $P_{rail}$, are the initial values of plunger and needle top displacements (when injector 202 is at rest). When the needle is closed, $P_{bv}$ ripples slightly due to the motion of plungers 306 and the needle top. If $\overline{P}_{bv}$ is defined as $P_{rail}-P_{bv}$, it is approximately equal to 0 in this situation. From equations (6) and (8), $F_{ns}=F_{ns}(0)$.

The dynamic state space equations are written as:

$$\begin{aligned}
\dot{X}_1 &= X_2 \\
\dot{X}_2 &= \frac{1}{M}\left[\begin{array}{l} -(k_{tot}+k)X_1 - b_1 X_2 + - \\ A_{bv}\overline{P}_{bv} - A_{obot}X_5 - f(X_6) \end{array}\right] \\
\dot{X}_3 &= X_4 \\
\dot{X}_4 &= \frac{-A_{nbot}X_5 - b_3 X_4 + A_{ntop}\overline{P}_{bv}}{m} + f_1 \\
\dot{X}_5 &= \beta\frac{A_{nbot}X_4 + A_{obot}X_2 + k_t(\overline{P}_{bv} - X_5)}{V_{tv}(0)} \\
\dot{X}_6 &= X_7 \\
\dot{X}_7 &= -2\zeta_d\omega_d X_7 - \omega_d^2 X_6 + \omega_d^2 V_{in}
\end{aligned} \qquad (18)-(24)$$

where $$f_1 = \begin{cases} -\dfrac{\left(k_{s1} + \dfrac{k_n k_{ns}}{k_n + k_{ns}}\right)X_3}{m} & \text{if } x_2 \le 0 \\ \dfrac{-k_{s1}X_3 + F_{ns} + k_n(x_1(0) - x_2(0))}{m} & \text{if } x_2 > 0 \end{cases} \qquad (25)$$

and output equations for injection rate $\omega_{stc}$ are $$x_2 = \begin{cases} \dfrac{F_{ns} + k_n(X_3 + x_1(0))}{k_n + k_{ns}} & \text{if } x_2 \le 0 \\ \dfrac{F_{ns} + k_n(X_3 + x_1(0))}{k_n + k_{ns}} & \text{if } x_2 > 0 \end{cases} \qquad (26)$$

$$w_{stc} = \frac{A_1(x_2)A_2}{\rho_{tub}}\sqrt{\frac{2\rho(P_{bv} - P_{cyl})}{A_1^2(x_2) + A_2^2}} \qquad (27)$$

Figure 7:
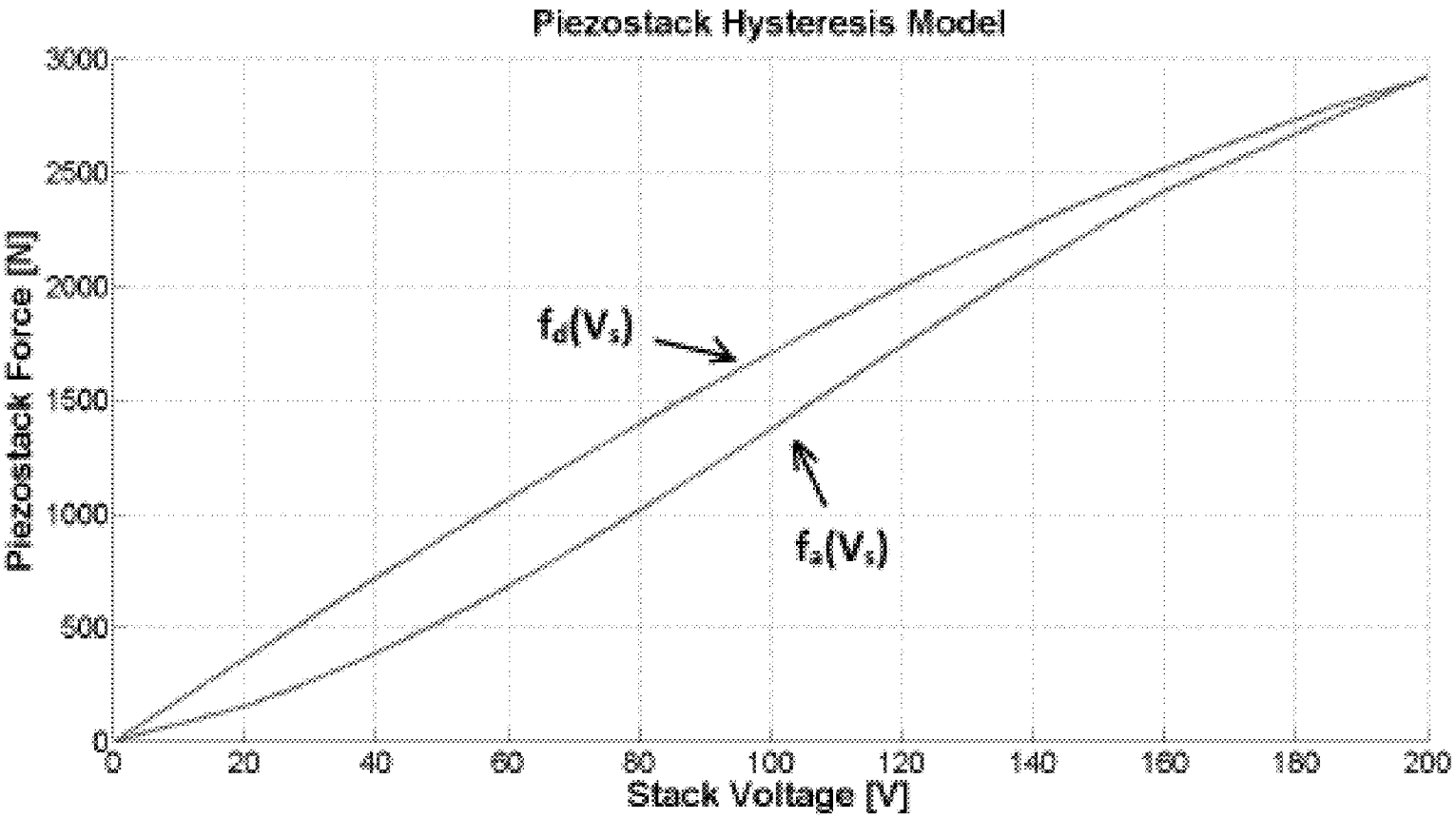
FIG. 7 is a graphical representation of a piezostack hysteresis model according to the present disclosure.

The hysteresis of piezostack 302 is modeled using the technique described Bashash, S., and Jalili, N., 2008, "A polynomial-based linear mapping strategy for feedforward compensation of hysteresis in piezoelectric actuators," *ASME Journal of Dynamic Systems, Measurement, and Control,* 130(3). In this model, the piezostack force $f(X_6)$ depends on the stack voltage $X_6$, turning points $[X_{61}, f(X_{61})]$, and $[X_{62}, f(X_{62})]$ $(X_{61} \le X_6 \le X_{62})$:

$$f(X_6) = f(X_{61}) + \frac{f(X_{62}) - f(X_{61})}{f_r(X_{62}) - f_r(X_{61})}(f_r(X_6) - f_r(X_{61})) \qquad (28)$$

where at each discrete time step k, as in FIG. 7:

$$f_r(X_6(k)) = \begin{cases} f_a(X_6(k)) & X_6(k) > X_6(k-1) \\ f_d(X_6(k)) & X_6(k) < K_6(k-1) \\ f_r(X_6(k-1)) & X_6(k) = X_6(k-1) \end{cases} \qquad (29)$$

The ascending and descending polynomials $f_a(X_6)$, $f_d(X_6)$ are third order:

$$f_a(X_6)=a_0+a_1X_6+a_2X_6^2+a_3X_6^3$$

$$f_d(X_6)=d_0+d_1X_6+d_2X_6^2+d_3X_6^3 \qquad (30)\text{-}(31)$$

A turning point is defined as the point at which stack voltage changes from increasing to decreasing and vice versa. Piezostack force is continuous ($C^0$) but not continuously differentiable ($C^1$) since its derivative does not exist at turning points. The estimated piezostack force derivatives are calculated as:

$$\hat{\dot{f}}(X_6) = \frac{\partial\hat{f}(X_6)}{\partial X_6}X_7 \qquad (32)$$

$$\frac{\partial\hat{f}(X_6)}{\partial X_6} = \frac{f(X_{62}) - f(X_{61})}{f_r(X_{62}) - f_r(X_{61})}\frac{\partial f_r(X_6)}{\partial X_6} \qquad (33)$$

where at each discrete time step k:

$$\frac{\partial f_r(X_6)}{\partial X_6} = \begin{cases} \dfrac{\partial f_a(X_6)}{\partial X_6} & \text{if } X_6(k) > X_6(k-1) \\ \dfrac{\partial f_d(X_6)}{\partial X_6} & \text{if } X_6(k) < X_6(k-1) \\ 0 & \text{if } X_6(k) = X_6(k-1) \end{cases} \qquad (34)-(36)$$

$$\frac{\partial f_a(X_6)}{\partial X_6} = a_1 + 2a_2X_6 + 3a_3X_6^2$$

$$\frac{\partial f_d(X_6)}{\partial X_6} = d_1 + 2d_2X_6 + 3d_3X_6^2$$

Figure 8:
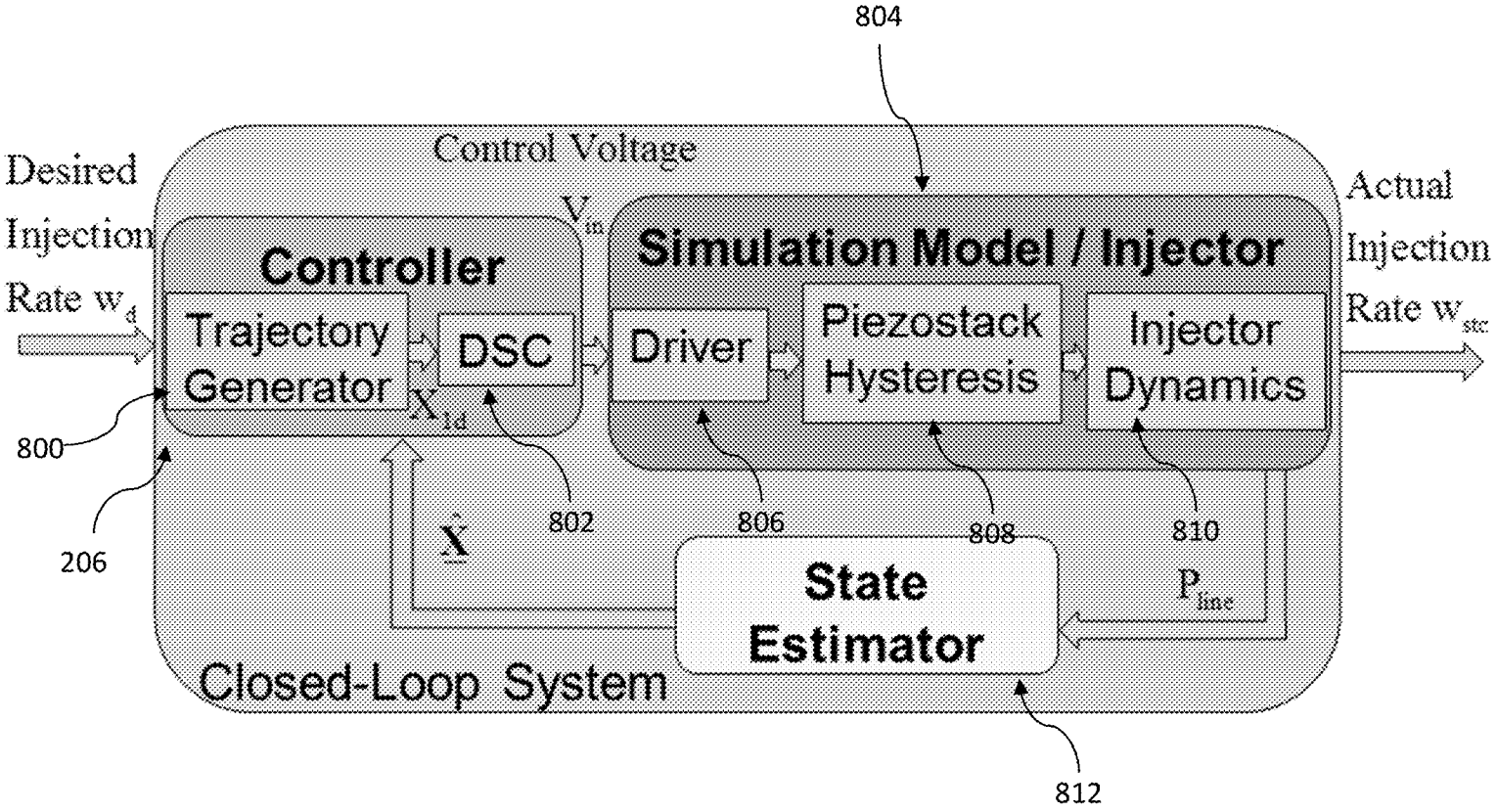
FIG. 8 is a block diagram of a control scheme according to the present disclosure.

The state space model of injector 202 contains seven states as described above and some nonlinearities, including the unsmoothness in the needle dynamics (equations (21) and (25)). FIG. 8 illustrates a block diagram of control software of controller 206 for injector 202 according to one embodiment of the present disclosure. As shown, the control software includes trajectory generator 800, a DSC 802, and state estimator 812. The injector model 804 includes model components for the driver 806, the piezostack hysteresis 808, and the injector dynamics 810.

The output of DSC 802 is the control voltage $V_{in}$. DSC is a backstepping-based strategy that uses first-order low-pass filters to avoid the repeated differentiations of modeled nonlinearities that traditional backstepping requires. Due to the high relative degree of the injector model (six), DSC is utilized to simplify the control development. In addition, DSC allows for the limitation of the rate of change of the control voltage, and avoids high order differentiations of the measured disturbance $P_{bv}$ that would exist in a backstepping scheme.

Trajectory generator 800 determines the displacement of the top of the needle of injector 202. The desired injection rate $\omega_d$ provided to trajectory generator 800 as shown in FIG. 8 is generated by a second-order low-pass filter with a stepwise input. The filter, $$G_{wd} = \frac{1}{(1+sT_f)^2}$$

is utilized as in Hagglund, T., 2012, "Signal filtering in PID control," *IFAC Conference on Advances in PID Control,* Brescia, Italy. The desired needle tip displacement $x_{2d}$ is calculated from $\omega_d$ based on equations (26) and (27):

$$x_{2d} = A_1^{-1}\left[\frac{w_d\rho_{tub}A_2}{\sqrt{2A_2^2\rho(P_{bv}-P_{cyl})-w_d^2\rho_{tub}^2}}\right] \tag{37}$$

Figure 9:
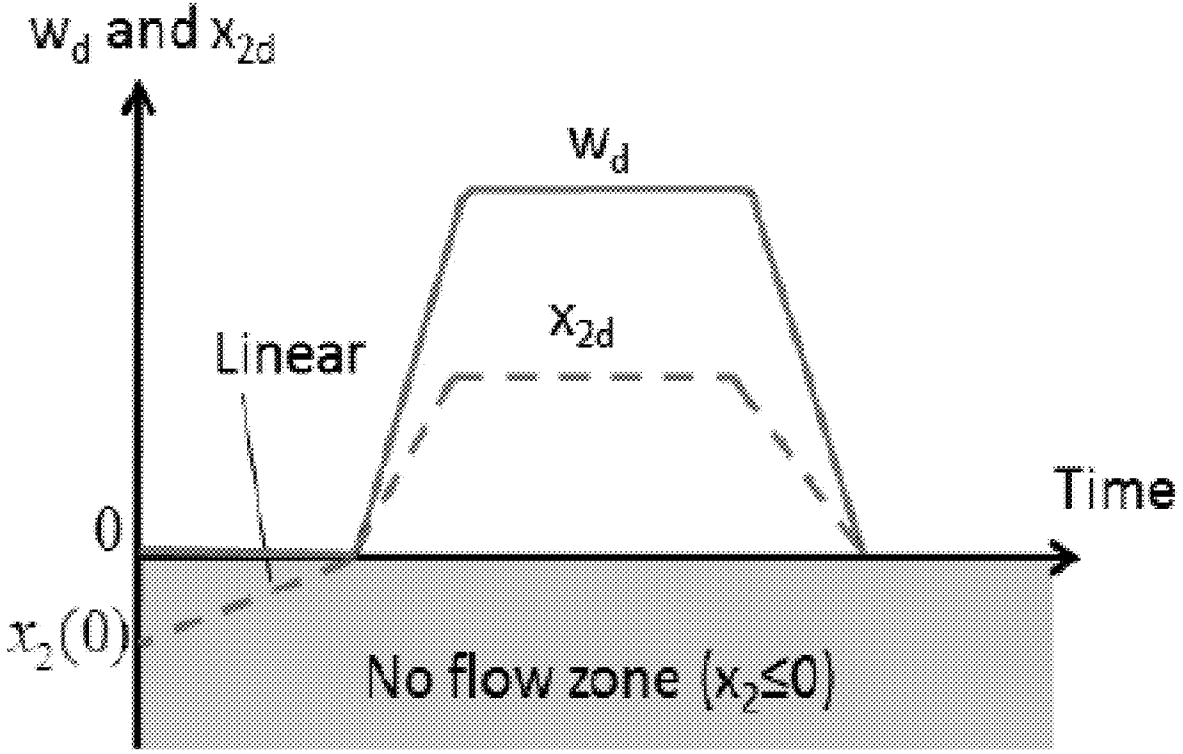
FIG. 9 is a graphical representation of variables involved in controlling needle top displacement according to the present disclosure.

Referring now to FIG. 9, when $\omega_d=0$, $x_{2d}$ can be any value less than zero, and a linear trajectory starting at $x_2(0)$ is chosen for trajectory generation of $x_{2d}$. The unfiltered relative desired needle top displacement $\overline{X}_3$ is calculated from desired needle tip displacement found above and the output relationship:

$$\overline{X}_3 = \begin{cases} \dfrac{(k_n+k_{ne})x_{2d}-F_{ne}}{k_n} - x_1(0) & \text{if } x_{2d} \le 0 \\ x_{2d} - \dfrac{F_{ns}}{k_n} - x_1(0) & \text{if } x_{2d} > 0 \end{cases} \tag{38}$$

A second-order low-pass filter is used to generate the desired needle top displacement fed to the controller $$\ddot{X}_{3d}+2\zeta\omega\dot{X}_{3d}+\omega^2X_{3d}=\omega^2\overline{X}_3 \tag{39}$$

The model described in equations (18)-(24) may be rewritten in a shorter form as follows:

$$\dot{X}_1=X_2$$

$$\dot{X}_2=-a_1X_1-a_2X_2-a_3\overline{P}_{bv}-a_4X_5++a_5f(X_6)$$

$$\dot{X}_3=X_4$$

$$\dot{X}_4=-a_6X_5-a_7X_4+a_8\overline{P}_{bv}+f_1(X_3, P_{bv})$$

$$\dot{X}_5=a_9X_4+a_{10}X_2+a_{11}(\overline{P}_{bv}-X_5)$$

$$\dot{X}_6=X_7$$

$$\dot{X}_7=-a_{12}X_6-a_{13}X_7+a_{14}V_{in} \tag{40)-(46}$$

where $a_1$-$a_{14}$ are constants, and $f(X_6)$ and $f_1(X_3, P_b)$ are $C^0$ but not $C^1$.

The needle top displacement error is defined as: $e=X_3-X_{3d}$. The DSC is derived as in the following steps.

Step 1: Surface error for step 1 is defined:

$$S_1=X_3-X_{3d}$$

$$\dot{S}_1=X_4-\dot{X}_{3d} \tag{46)-(47}$$

$\overline{X}_4$ is defined to drive $S_1$ to 0:

$$\overline{X}_4=\dot{X}_{3d}-K_1S_1 \tag{48}$$

A first-order low-pass filter is used to obtain desired trajectory for $X_4$:

$$\tau_2\dot{X}_{4d}+X_{4d}=\overline{X}_4 \tag{49}$$

Step 2: Surface error for step 2 is defined:

$$S_2=X_4-X_{4d}$$

$$\dot{S}_2=-a_6X_5-a_7X_4+a_8\overline{P}_{bv}+f_1(X_3, P_{bv})+-\dot{X}_{4d} \tag{50)-(51}$$

$\overline{X}_5$ is defined to drive $S_2$ to 0:

$$\overline{X}_5 = \frac{a_7X_4 - a_8\overline{P}_{bv} - f_1(X_3, P_{bv}) + \dot{X}_{4d} - K_2S_2}{-a_6} \tag{52}$$

A first-order low-pass filter is used to obtain desired trajectory for $X_5$:

$$\tau_3\dot{X}_{5d}+X_{5d}=\overline{X}_5 \tag{53}$$

Step 3: Surface error for step 3 is defined:

$$S_3=X_5-X_{5d}$$

$$\dot{S}_3=a_9X_4+a_{10}X_2+a_{11}(\overline{P}_{bv}-X_5)+-\dot{X}_{5d} \tag{54)-(55}$$

$\overline{X}_2$ is defined to drive $S_3$ to 0:

$$\overline{X}_2 = \frac{\dot{X}_{5d} - a_9X_4 - a_{11}(\overline{P}_{bv} - X_5) - K_3S_3}{a_{10}} \tag{56}$$

A first-order low-pass filter is used to obtain the desired trajectory for $X_2$:

$$\tau_4\dot{X}_{2d}+X_{2d}=\overline{X}_2 \tag{57}$$

Step 4: Surface error for step 4 is defined:

$$S_4=X_2-X_{2d}$$

$$\dot{S}_4=-a_1X_1-a_2X_2-a_3\overline{P}_{bv}-a_4X_5++a_5f(X_6)-\dot{X}_{2d} \tag{58)-(59}$$

$\overline{f}(X_6)$ is defined to drive $S_4$ to 0:

$$\overline{f}(X_6) = \frac{1}{a_5}\left(\dot{X}_{2d} + a_1X_1 + a_2X_2 + a_3\overline{P}_{bv} + a_4X_5 - K_4S_4\right) \tag{60}$$

A first-order low-pass filter is used to obtain desired trajectory for $f(X_6)$:

$$\tau_5\dot{f}(X_6)_3+f(X_6)_d=\overline{f}(X_6) \tag{61}$$

Step 5: Surface error for step 5 is defined:

$$S_5=f(X_6)-f(X_6)_d \tag{62}$$

Since $S_5$ is not $C^1$, the generalized gradient and the chain rule are utilized to calculate the set-valued derivative of $S_5$:

$$\dot{\tilde{S}}_5 = \overline{K}\left[\frac{\partial f(X_6)}{\partial X_6}\right]X_7 - \dot{f}(X_6)_d \tag{63}$$

$X_7$ is defined to drive $S_5$ to 0:

$$\overline{X}_7 = \left(\frac{\partial\hat{f}(X_6)}{\partial X_6}\right)^{-1}\left(\dot{f}(X_6)_d - K_5S_5\right) \tag{64}$$

A first-order low-pass filter is used to obtain desired trajectory for $X_7$:

$$\tau_6\dot{X}_{7d}+X_{7d}=\overline{X}_7 \tag{65}$$

Step 6: Surface error for step 6 is defined:

$$S_6=X_7-X_{7d}$$

$$\dot{S}_6=-a_{12}X_6-a_{13}X_7+a_{14}V_{in}-\dot{X}_{7d} \tag{66)-(67}$$

Finally, the control voltage $V_{in}$ is defined to drive $S_6$ to 0:

$$V_{in}=\frac{a_{12}X_6+a_{13}X_7+\dot{X}_{7d}-K_6S_6}{a_{14}} \tag{68}$$

As indicated above, an NI CompactRIO system (designated controller 206) may be used with LabVIEW FPGA for rapid control prototyping. Since the control strategy has a high order and requires a high sampling rate, hardware resource and timing limitations are considerations for implementation. Accordingly, the present disclosure implements several processing strategies.

Figure 10:
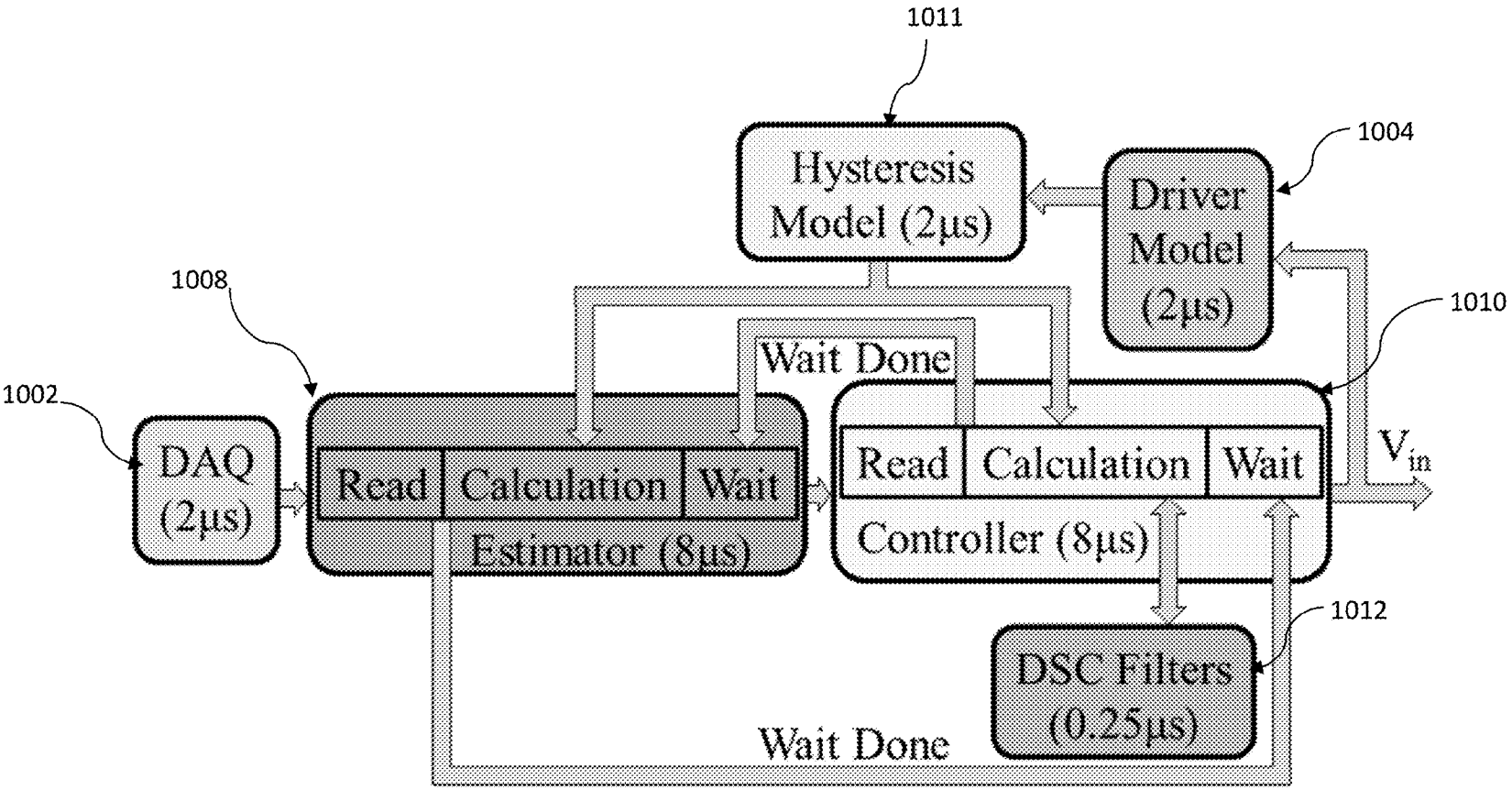
FIG. 10 is a block diagram of parallel execution aspects of the present disclosure.

One processing strategy is parallel execution. In one embodiment, fast calculation is implemented using FPGA parallelism for different tasks. An example estimation and control scheme is illustrated in FIG. 10. FIG. 10 depicts six main loops: DAQ 1002, Driver Model 1004, Estimator 1008, Controller 1010, Hysteresis Model 1011, and DSC Filters 1012. In this scheme, DAQ 1002, Driver Model 104, Hysteresis Model 1011 and DSC Filers 1012 loops run freely at as high a rate as possible. Controller 1010 starts calculating whenever estimated states are ready and vice versa by hand-shaking with Estimator 1008.

Another processing strategy is serial execution. Besides sampling rate maximization, it is desirable to minimize the required FPGA computational resources. In one embodiment, FPGA programming with LabVIEW is utilized to optimize Estimator 1008. In short, to reduce FPGA logic resource consumption, block memory may be used along with matrix calculations to reduce the number of math operations. The Estimator 1008 implementation is arranged into matrix equations. The strategy is performed per each matrix equation as follows:

$$\begin{bmatrix} Y_1 \\ Y_2 \\ \dots \\ Y_n \end{bmatrix} = \begin{bmatrix} A_{11} & A_{12} & \dots & A_{1n} \\ A_{21} & A_{22} & \dots & A_{2n} \\ \dots & \dots & \dots & \dots \\ A_{n1} & A_{n2} & \dots & A_{nn} \end{bmatrix} \begin{bmatrix} X_1 \\ X_2 \\ \dots \\ X_n \end{bmatrix} ++ \begin{bmatrix} B_1 \\ B_2 \\ \dots \\ B_n \end{bmatrix} u \tag{69}$$

or Y=AX+Bu. The one-dimensional matrices Y, $\overline{A}$, X, and B are each stored in block memory, where $$\overline{A}=[A_{11}\dots A_{1n}\dots A_{n1}\dots A_{nn}] \tag{70}$$

Equation (69) becomes $$Y_i=\sum_{j=1}^{n}\overline{A}_{(ni+j)}X_j+B_iu \tag{71}$$

$$\text{Define } Y_{ij}=\sum_{k=1}^{j}\overline{A}_{(ni+k)}X_k \Rightarrow Y_{ij}=Y_{i(j-1)}+\overline{A}_{(ni+j)}X_j$$

$$\Rightarrow Y_i=Y_{in}+B_iu \tag{72}$$

Figure 11:
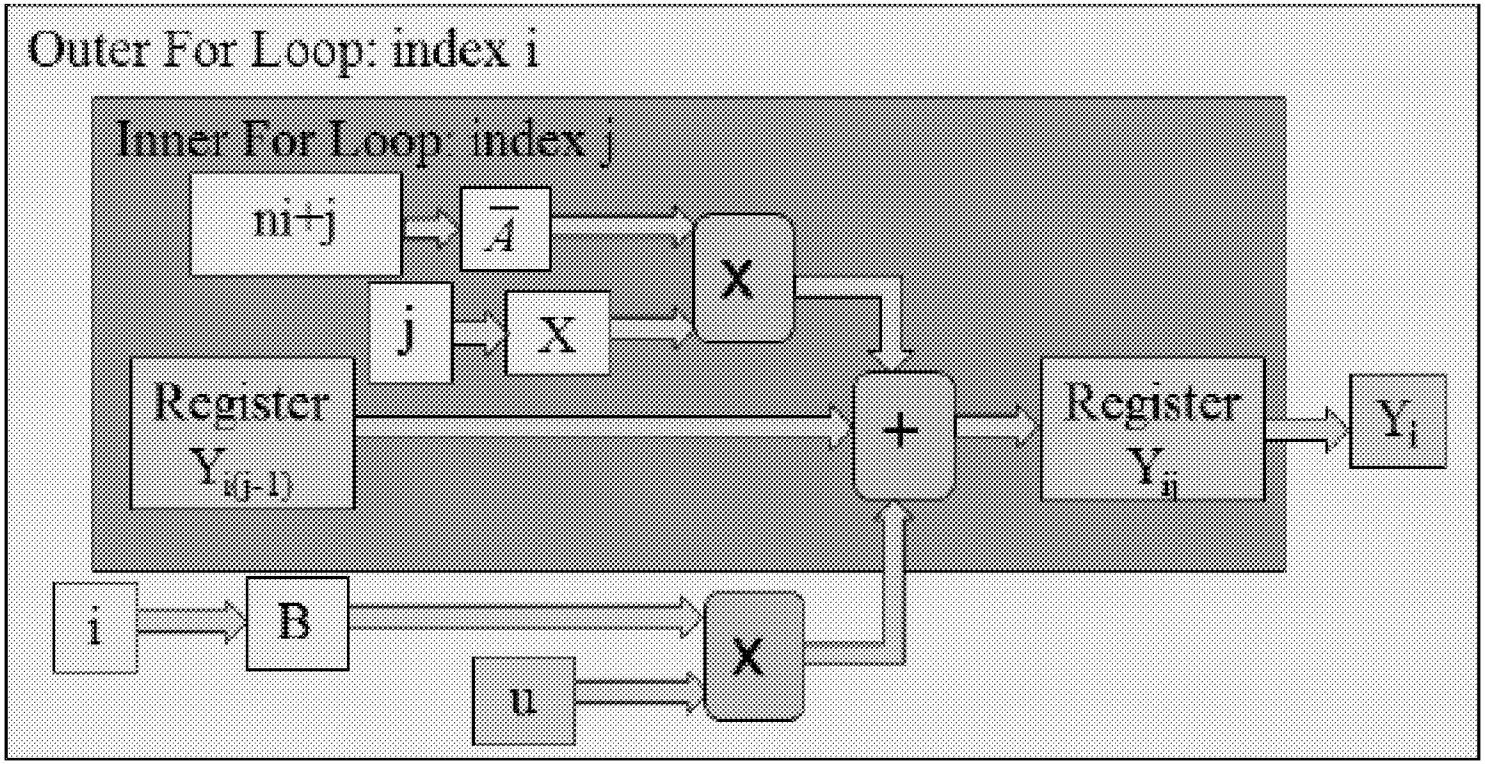
FIG. 11 is a block diagram of serial execution aspects of the present disclosure.

Serializing the math operations in equation (69) using block memory, a shift register, and for loops is illustrated in FIG. 11. The number of mathematic operators is greatly reduced from $n^2+n$ multiplications and $n^2$ summations when using single calculations (equation (69)) to three multiplications and two summations. In addition, using block memory reduces the need for FPGA logic resources.

Figure 12:
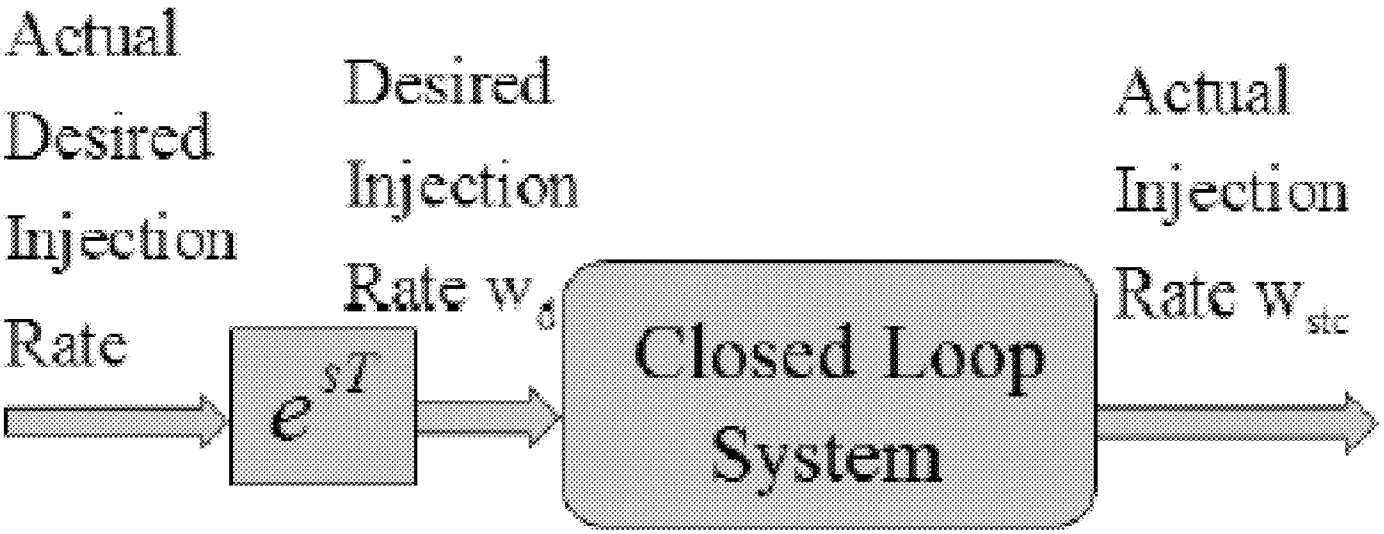
FIG. 12 is a block diagram of reference shaping for bandwidth limited compensation.

Yet another processing strategy is bandwidth limitation. The above-described estimation and control scheme experiences a limitation in closed-loop bandwidth due to the delay of algorithm calculation and phase lag of the filters in trajectory generator 800, resulting in a delay in the response. In addition, the closed-loop bandwidth is limited to avoid high frequency control effort. Therefore, the control gains $K_1, K_2, \dots, K_6$ (equations (48), (52), (56), (60), (64), and (68)) and the time constants $\tau_2, \tau_3, \dots, \tau_6$ of the DSC filters (equations (49), (53), (57), (61), (65)) must be tuned low and high enough, respectively. Since the desired injection flow rate is scheduled ahead of time, a pure delay compensator $e^{sT}$ is utilized as the reference shaper of the desired input. The block diagram of the implemented control system (refer to FIG. 8) is illustrated in FIG. 12.

Figure 13:
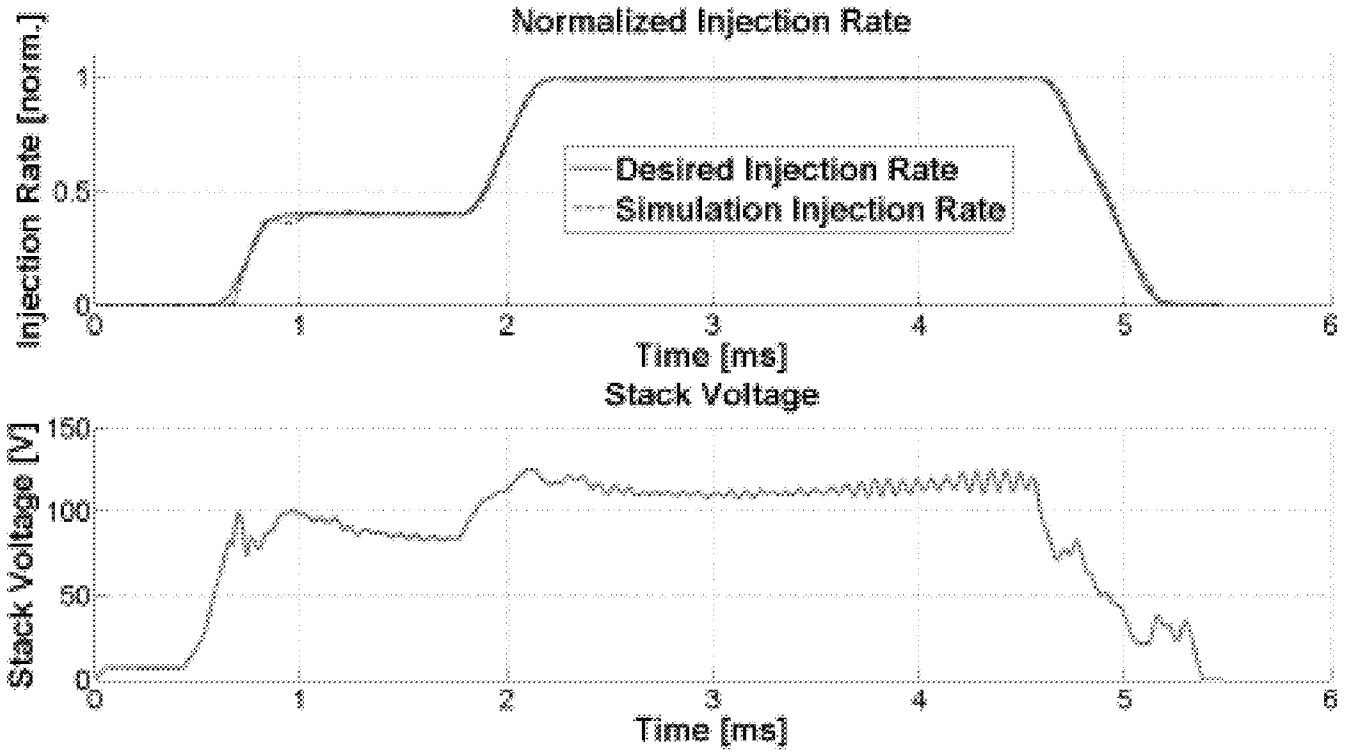
FIGS. 13-16 are graphical representations of simulation results of the system of the present disclosure.
Figure 14:
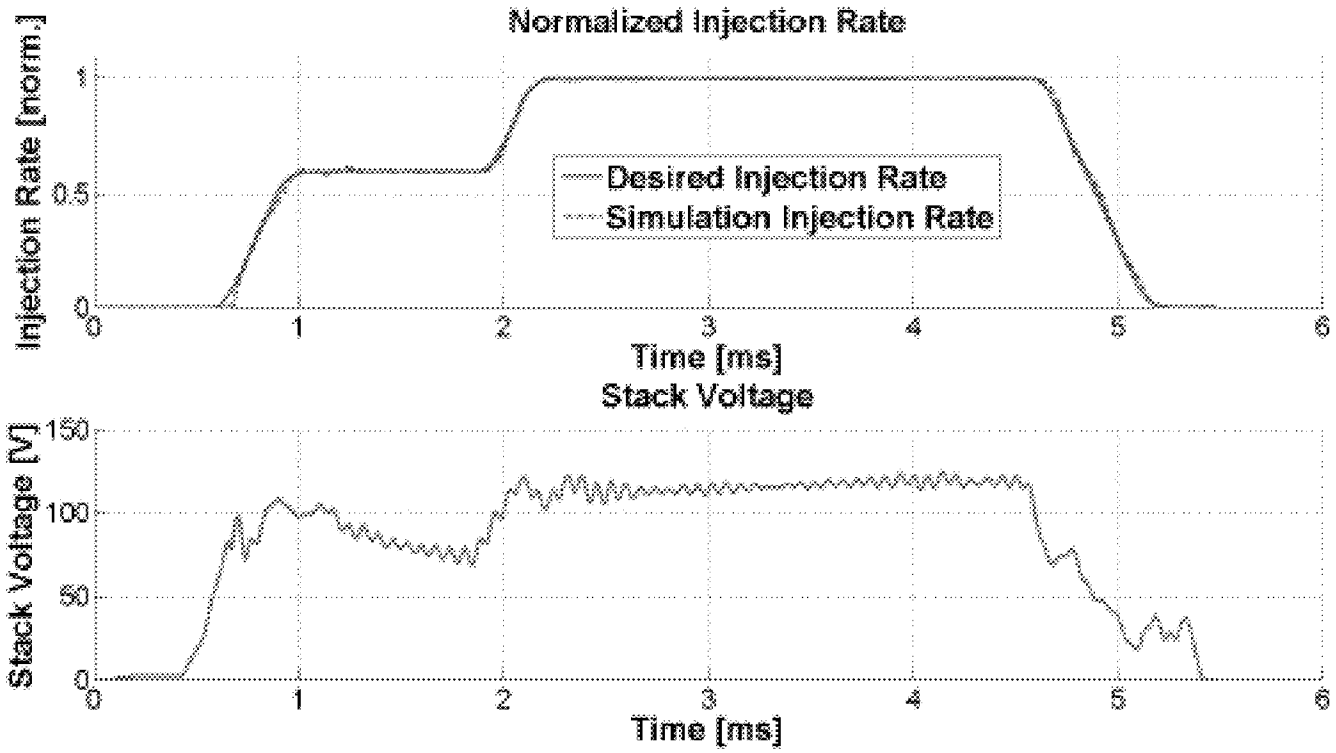
Figure 15:
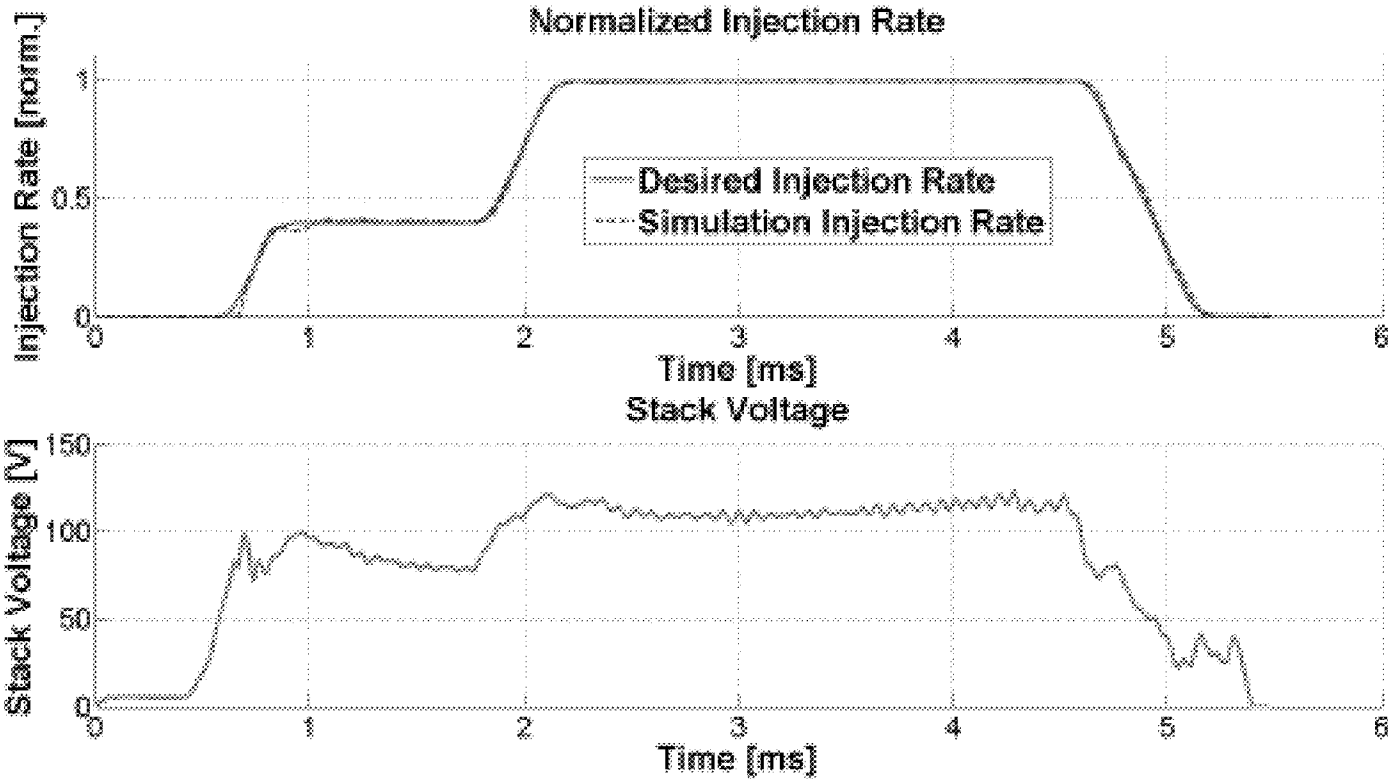
Figure 16:
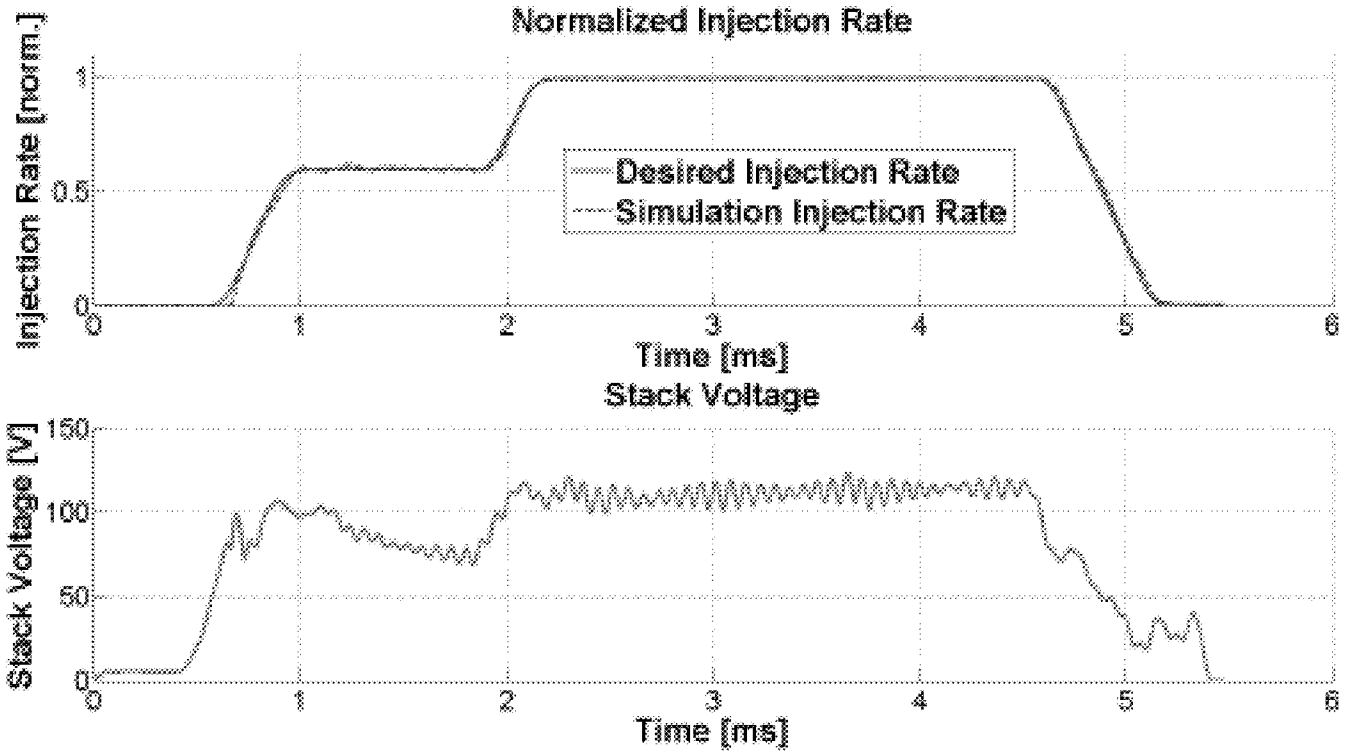

Using MATLAB, simulation results for the normalized desired boot shape profiles, and control voltages of 70 bar cylinder pressure, 500 bar, and 600 bar rail pressures are shown in FIG. 13-FIG. 16. FIG. 13 depicts the normalized injection rate and control voltage at 500 bar rail pressure forming a toe height of 40%. FIG. 14 depicts the normalized injection rate and control voltage at 500 bar rail pressure forming a toe height of 60%. FIG. 15 depicts the normalized injection rate and control voltage at 600 bar rail pressure forming a toe height of 40%. FIG. 16 depicts the normalized injection rate and control voltage at 600 bar rail pressure forming a toe height of 60%. These figures show that the closed-loop system is capable of tracking desired injection rate profiles in simulation.

Figure 17:
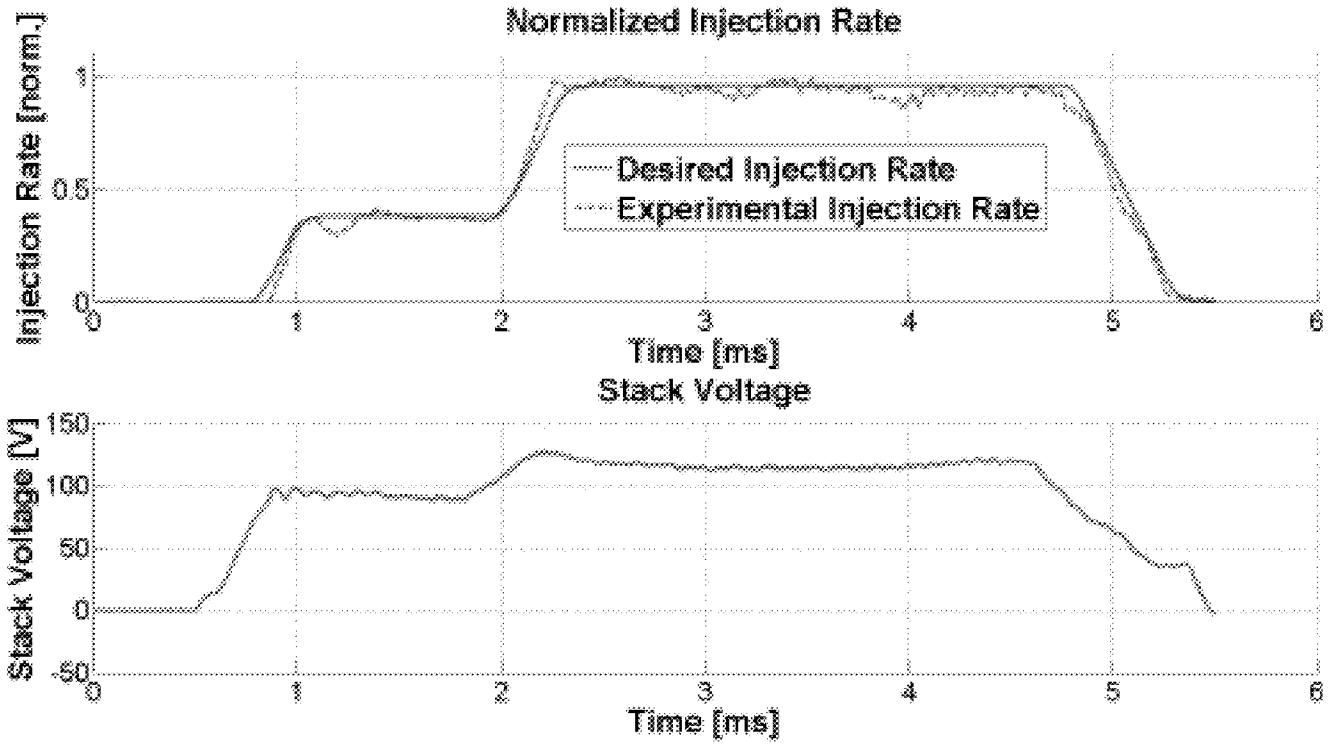
FIGS. 17-20 are graphical representations of experimental results of the system of the present disclosure.
Figure 18:
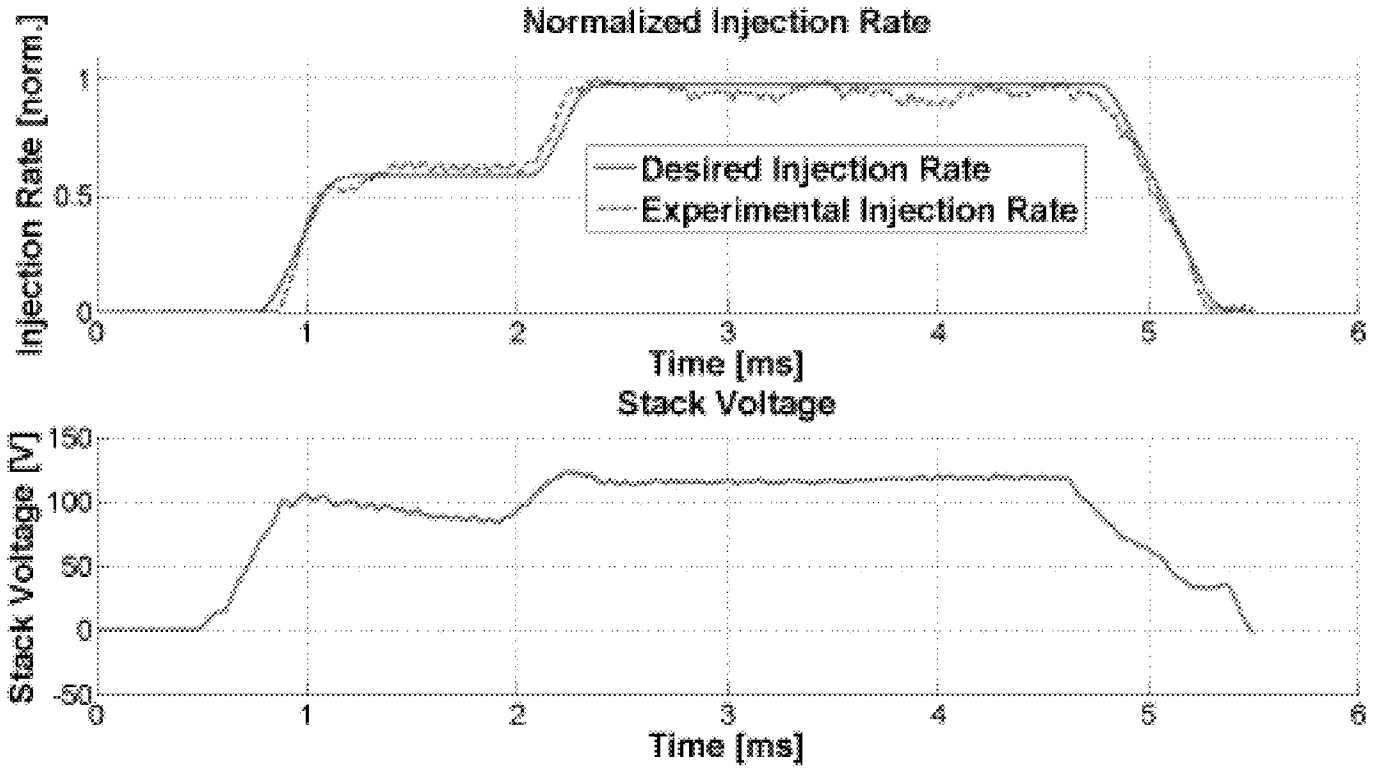
Figure 19:
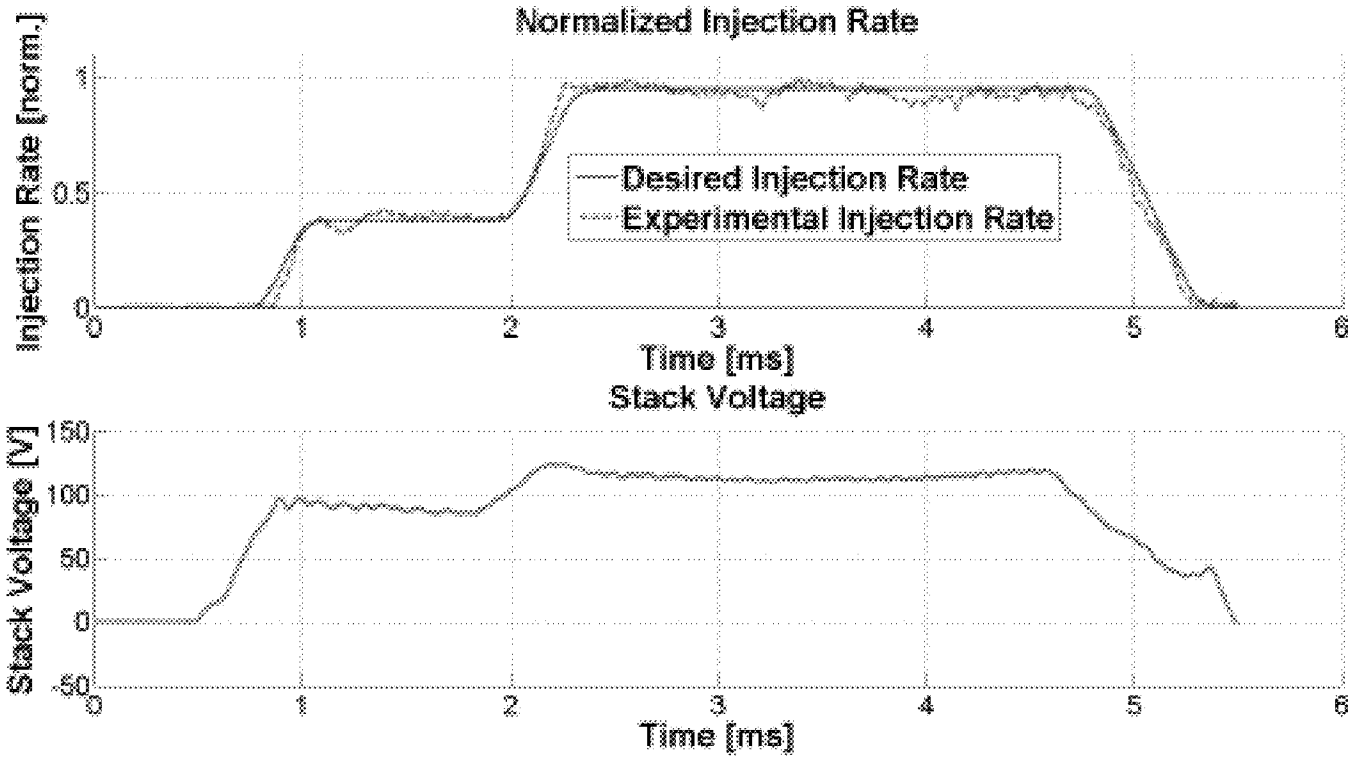
Figure 20:
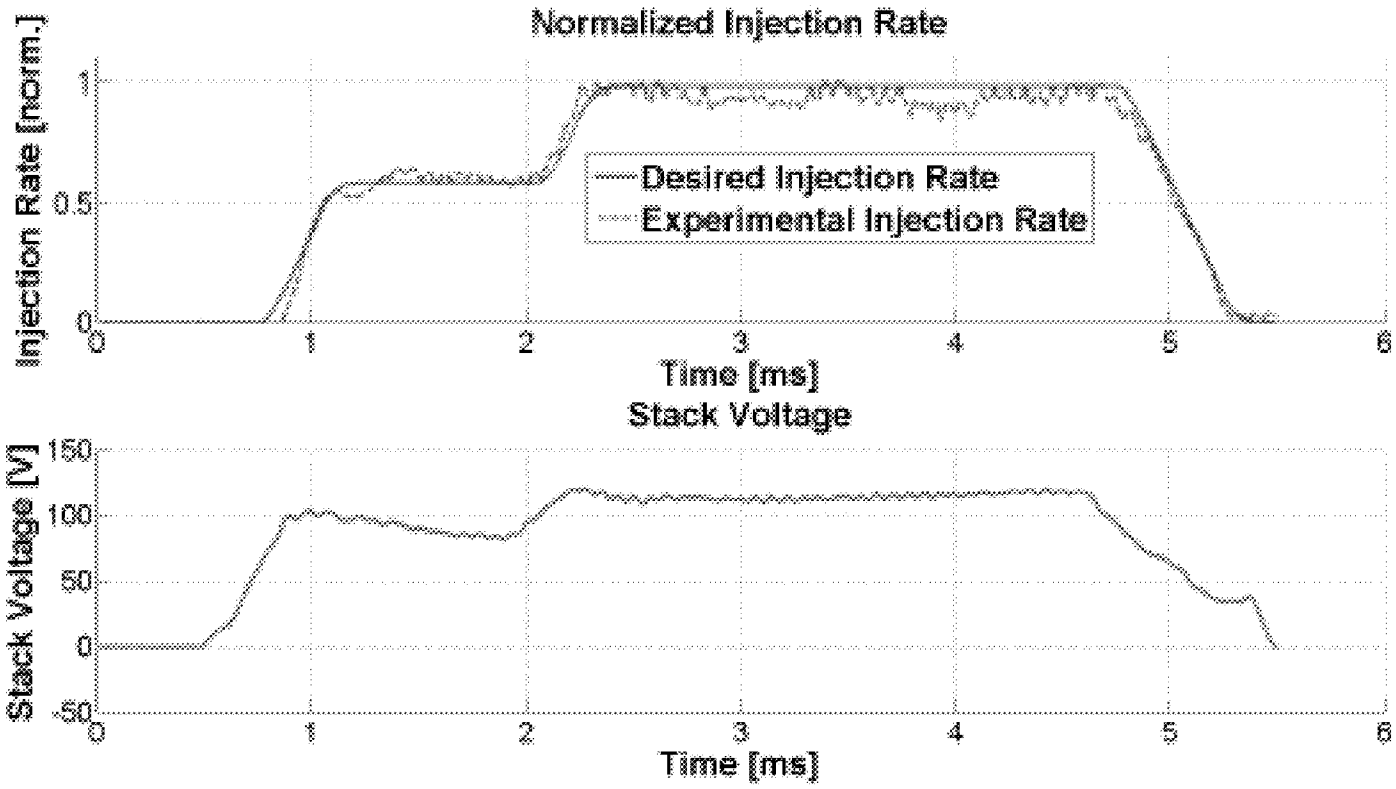

Experimental results for the normalized desired boot shape profiles, and control voltages at 70 bar cylinder pressure, 500 bar, and 600 bar rail pressures are shown in FIG. 17-FIG. 20. FIG. 17 depicts the normalized injection rate and control voltage at 500 bar rail pressure forming a toe height of 40%. FIG. 18 depicts the normalized injection rate and control voltage at 500 bar rail pressure forming a toe height of 60%. FIG. 19 depicts the normalized injection rate and control voltage at 600 bar rail pressure forming a toe height of 40%. FIG. 20 depicts the normalized injection rate and control voltage at 600 bar rail pressure forming a toe height of 60%. From these figures, the closed-loop system achieves good steady state errors and transient response.

Table 1 shows indices used to evaluate control performance:

(1) Relative injected fuel error $$\text{Fuel error } [\%]=\frac{\int_0^T e(t)dt}{\int_0^T w_d(t)dt}\approx\frac{\sum_{i=1}^{n}e\Delta T}{\sum_{i=1}^{n}w_d\Delta T} \tag{73}$$

(2) Relative root mean square error during toe and shank $$e_{rms}[\%]=\sqrt{\frac{\int_{T_1}^{T_2}e^2(t)dt}{\int_{T_1}^{T_2}w_d^2(t)dt}}\approx\sqrt{\frac{\sum_{i=1}^{n}e_i^2}{\sum_{i=1}^{n}w_{di}^2}} \tag{74}$$

where $\omega_d$ is desired volumetric injection flow rate, and $e=\omega_{stc}-\omega_d$.

(3) Start of Injection (SOI) is the time at which the fuel starts being injected: $e_{SOI}=SOI_{stc}-SOI_d$. As shown in Table 1, the errors in the total injected fuel and fuel injected during shank are less than 3%.

TABLE 1

| INDEX | FIG. 17 | FIG. 18 | FIG. 19 | FIG. 20 |
|---|---|---|---|---|
| Injected Fuel (%) | −2.5 | −2.2 | −1.5 | −2.5 |
| Injected Fuel at Toe (%) | −6.4 | 1.1 | −0.7 | −0.3 |
| Injected Fuel at Shank (%) | −1.9 | −2.8 | −1.6 | −3.0 |
| RMS at Toe (%) | 10.1 | 7.7 | 9.6 | 7.6 |
| RMS at Shank (%) | 5.0 | 5.4 | 4.7 | 5.1 |
| SOI (ms) | 0.1 | 0.1 | 0.1 | 0.1 |

As described previously, injection flow rate control is particularly challenging during the "toe," at which point the needle is "hovering" between fully opened and fully closed. The control strategy is also effective during this challenging condition, as illustrated in Table 1 showing errors in injected fuel amount during the toe of no more than 6.4%.

The results show that with the DSC, the closed-loop system is capable of tracking desired fuel injection rate profiles. The DSC 802 uses states estimated from a reduced-order state estimator and measurement of line pressure. While the embodiments have been described as having exemplary designs, the present disclosure may be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this invention pertains.

The invention claimed is:

1. A method, comprising:

monitoring a pressure of fuel supplied to a fuel injector of an engine; and providing a control input voltage to a piezostack of the fuel injector in response to the pressure to cause the injector to provide a fuel injection having a desired shape;

wherein providing a control input voltage includes applying a model-based algorithm to the pressure to determine the control input voltage.

2. The method of claim 1, wherein providing a control input voltage includes causing the injector to provide a fuel injection having a boot shape with a shank wherein a needle valve of the fuel injector is fully opened and a toe wherein the needle valve is partially opened.

3. The method of claim 1, wherein providing a control input voltage includes applying a state space model having seven dynamic states to the pressure.

4. The method of claim 1, wherein providing a control input voltage includes applying a model-based algorithm having a hysteresis model of the piezostack to an output voltage of the piezostack.

5. The method of claim 1, wherein the control input voltage is provided to the piezostack to cause an upper section of the needle valve to move to a desired position which is determined by applying the model-based algorithm, the desired position corresponding to a desired fuel flow rate through a needle valve of the fuel injector.

6. The method of claim 1, further including repeating monitoring the pressure, and providing the control signal a plurality of times during each cycle of operation of the engine.

7. A system, comprising:

a piezostack driver configured to provide a stack voltage to a piezostack of a fuel injector of an engine;

a voltage sensor disposed in electrical communication with the stack voltage and configured to provide stack voltage measurement signals representing the stack voltage;

a pressure sensor disposed in fluid communication with a fuel supply to the fuel injector and configured to provide line pressure measurement signals representing a fuel pressure of a body of the injector; and a controller coupled to the piezostack driver, the voltage sensor, and the pressure sensor, the controller including logic to apply the line pressure measurement signals to a model of the fuel injector to generate control input signals, the controller providing the control input signals to the piezostack driver to cause the piezostack driver to provide stack voltages such that the fuel injector provides a fuel injection having a desired shape.

8. The system of claim 7, wherein the model includes a state space model having seven dynamic states.

9. The system of claim 7, wherein the control input signals are generated to cause the piezostack driver to provide stack voltages such that the fuel injector provides a fuel injection having a boot shape with a shank wherein a needle valve of the fuel injector is fully opened and a toe wherein the needle valve is partially opened.

10. The system of claim 7, wherein the model includes a hysteresis model of the piezostack of the fuel injector.

11. The system of claim 7, wherein the controller logic applies the line pressure measurement signals to the model a plurality of times during each cycle of operation of the engine.

12. The system of claim 7, wherein the controller is an FPGA based controller.

13. A controller, including:

a feedback interface configured to receive line pressure measurement signals representing fuel pressures of a body of the injector;

a control interface configured to output control signals to a piezostack driver associated with the fuel injector; and an FPGA coupled to the feedback interface and the control interface, the FPGA being programmed to apply the line pressure measurement signals to a model-based algorithm and providing resulting control signals through the control interface to cause the injector to provide a fuel injection having a desired shape.

14. The controller of claim 13, wherein the desired shape is a boot shape with a shank wherein a needle valve of the fuel injector is fully opened and a toe wherein the needle valve is partially opened.

15. The controller of claim 13, wherein the model-based algorithm includes a state space model having seven dynamic states.

16. The controller of claim 13, wherein the model-based algorithm includes a hysteresis model of the piezostack of the fuel injector.

17. The controller of claim 13, wherein the FPGA generates the control signals to cause the injector to provide a fuel injection a plurality of times in a single engine cycle.

18. The controller of claim 13, wherein the FPGA generates the control signals to cause an upper section of a needle valve of the fuel injector to move to a desired position corresponding to a desired fuel flow rate through the needle valve.

19. The controller of claim 13, wherein the FPGA is configured to generate a control signal in response to a line pressure measurement signal at least once every eight microseconds.

20. The controller of claim 13, wherein the feedback interface receives the line pressure measurement signals at a sampling rate of at least 500 kHz.

21. The controller of claim 13, wherein the model-based algorithm includes seven model states defined as:

$$X_1=y-y(0)$$

$$X_2=\dot{y}$$

$$X_3=x_1-x_1(0)$$

$$X_4=\dot{x}_1$$

$$X_5=P_{rail}-P_{tv}$$

$$X_6=V_s$$

$$X_7=\dot{V}_s$$

where $P_{tv}(0)=P_{rail}$, and $y(0)$, $x_1(0)$, which depend on $P_{rail}$, are the initial values of a displacement of a plunger of the fuel injector and a needle top of the fuel injector when the fuel injector is at rest.

* * * * *